US008391748B2

(12) United States Patent
Miyabe et al.

(10) Patent No.: US 8,391,748 B2
(45) **Date of Patent: *Mar. 5, 2013**

(54) CARTRIDGE, ASSEMBLING METHOD FOR CARTRIDGE, AND DISASSEMBLING METHOD FOR CARTRIDGE

(75) Inventors: Shigeo Miyabe, Numazu (JP); Takahito Ueno, Mishima (JP); Atsushi Takasaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/363,788

(22) Filed: Feb. 1, 2012

(65) Prior Publication Data

US 2012/0195635 A1 Aug. 2, 2012

Related U.S. Application Data

(62) Division of application No. 12/486,175, filed on Jun. 17, 2009, now Pat. No. 8,233,821.

(30) Foreign Application Priority Data

Jun. 20, 2008 (JP) ..... 2008-161117
May 13, 2009 (JP) ..... 2009-116176

(51) Int. Cl.
*G03G 15/04* (2006.01)

(52) U.S. Cl. ..... 399/119; 399/109

(58) Field of Classification Search ..... 399/109, 399/119

See application file for complete search history.

(56) References Cited

U.S. PATENT DOCUMENTS 5,331,373 A 7/1994 Nomura et al.
5,452,056 A 9/1995 Nomura et al.
(Continued)

FOREIGN PATENT DOCUMENTS

CN 1304063 A 7/2001
CN 1621969 6/2005
(Continued)

OTHER PUBLICATIONS

Chinese Office Action dated Sep. 30, 2010, in counterpart Chinese Patent Application No. 200910150307.9, and English translation thereof.

(Continued)

*Primary Examiner* — Ryan Walsh
(74) *Attorney, Agent, or Firm* — Fitzpatrick, Cella, Harper & Scinto

(57) ABSTRACT

A cartridge is detachably mountable to the main assembly of an electrophotographic image forming apparatus. The cartridge comprises a developer accommodating portion for accommodating a developer, and a developing roller for developing an electrostatic latent image formed on an electrophotographic photosensitive drum with the developer. A rotational force receiving member is provided for receiving a rotational force for rotating the developing roller. A side cover is provided with an elastic member and an inclination regulating portion for regulating an inclination of the rotational force receiving member. The side cover is mounted to a cartridge frame by the fastening member, with the rotational force receiving member being mounted to the cartridge frame integrally with the side cover.

4 Claims, 24 Drawing Sheets

U.S. PATENT DOCUMENTS 5,463,446 A 10/1995 Watanabe et al.
5,585,889 A 12/1996 Shishido et al.
5,640,650 A 6/1997 Watanabe et al.
5,839,028 A 11/1998 Nomura et al.
5,873,012 A 2/1999 Miyabe et al.
5,878,309 A 3/1999 Nomura et al.
5,878,310 A 3/1999 Noda et al.
5,926,666 A 7/1999 Miura et al.
5,943,529 A 8/1999 Miyabe et al.
5,946,531 A 8/1999 Miura et al.
5,950,047 A 9/1999 Miyabe et al.
5,966,567 A 10/1999 Matsuzaki et al.
6,029,031 A 2/2000 Yokomori et al.
6,064,843 A 5/2000 Isobe et al.
6,072,968 A 6/2000 Nomura et al.
6,128,452 A 10/2000 Miyabe et al.
6,154,623 A 11/2000 Suzuki et al.
6,167,219 A 12/2000 Miyamoto et al.
6,173,140 B1 1/2001 Suzuki et al.
6,215,969 B1 4/2001 Nomura et al.
6,282,390 B1 8/2001 Miyabe et al.
6,317,572 B1 11/2001 Miyabe et al.
6,336,017 B1 1/2002 Miyamoto et al.
6,351,620 B1 2/2002 Miyabe et al.
6,385,416 B1 5/2002 Horikawa et al.
6,415,121 B1 7/2002 Suzuki et al.
6,505,020 B1 1/2003 Higeta et al.
6,519,431 B1 2/2003 Toba et al.
6,542,706 B2 4/2003 Toba et al.
6,549,736 B2 4/2003 Miyabe et al.
6,603,939 B1 8/2003 Toba et al.
6,608,980 B2 8/2003 Murayama et al.
6,678,488 B2 1/2004 Toba et al.
6,714,752 B2 3/2004 Ueno et al.
6,795,666 B2 9/2004 Miyabe et al.
6,829,455 B2 12/2004 Yasumoto et al.
6,836,629 B2 12/2004 Miyabe et al.
6,898,391 B2 5/2005 Numagami et al.
6,912,365 B2 6/2005 Ueno et al.
6,931,226 B2 8/2005 Chadani et al.
6,934,485 B2 8/2005 Miyabe et al.
6,954,601 B2 10/2005 Numagami et al.
6,968,146 B1 11/2005 Fujita et al.
6,970,668 B2 11/2005 Ueno et al.
6,978,099 B2 12/2005 Ueno et al.
7,003,247 B2 2/2006 Koishi et al.
7,062,200 B2 6/2006 Ueno et al.
7,092,658 B2 8/2006 Yasumoto et al.
7,136,604 B2 11/2006 Chadani et al.
7,139,502 B2 11/2006 Koishi et al.
7,149,457 B2 12/2006 Miyabe et al.
7,155,141 B2 12/2006 Sato et al.
7,158,736 B2 1/2007 Sato et al.
7,158,749 B2 1/2007 Ueno et al.
7,162,181 B2 1/2007 Maeshima et al.
7,164,875 B2 1/2007 Miyabe et al.
7,174,122 B2 2/2007 Fujita et al.
7,184,690 B2 2/2007 Ueno et al.
7,209,682 B2 4/2007 Numagami et al.
7,212,768 B2 5/2007 Numagami et al.
7,248,810 B2 7/2007 Miyabe et al.
7,315,710 B2 1/2008 Ueno et al.
7,366,452 B2 4/2008 Fujita et al.
7,440,715 B2 10/2008 Numagami et al.
7,450,877 B2 11/2008 Miyabe et al.
7,457,566 B2 11/2008 Koishi et al.
7,483,646 B2 1/2009 Ueno et al.
7,499,663 B2 3/2009 Sato et al.
2005/0115043 A1 6/2005 Maeshima et al.
2005/0232654 A1 10/2005 Karakama et al.
2006/0269318 A1 11/2006 Ueno et al.
2008/0152388 A1 6/2008 Ueno et al.
2008/0260428 A1 10/2008 Ueno et al.
2008/0286000 A1 11/2008 Kimizuka et al.
2008/0286004 A1 11/2008 Kimizuka et al.
2009/0047037 A1 2/2009 Miyabe et al.
2009/0074454 A1 3/2009 Sato et al.
2009/0092411 A1 4/2009 Ueno et al.
2009/0226206 A1 9/2009 Ueno et al.
2009/0317134 A1* 12/2009 Miyabe et al. ..... 399/119

FOREIGN PATENT DOCUMENTS

JP 2007-241186 9/2007

OTHER PUBLICATIONS

Office Action in Chinese Patent Application No. 201110274443.6, mailed Oct. 9, 2012 (with English translation).

* cited by examiner

CARTRIDGE, ASSEMBLING METHOD FOR CARTRIDGE, AND DISASSEMBLING METHOD FOR CARTRIDGE

This is a divisional of co-pending U.S. patent application Ser. No. 12/486,175, filed Jun. 17, 2009.

FIELD OF THE INVENTION AND RELATED ART

The present invention relates to a cartridge, an assembling method for the cartridge, and a disassembling method for the cartridge used in an electrophotographic image forming apparatus.

Here, in the electrophotographic image forming apparatus an image is formed on a recording material using an electrophotographic image forming process. The examples of the electrophotographic image forming is apparatus include an electrophotographic copying machine, an electrophotographic printer (laser beam printer, LED printer, and so on), a facsimile device, a word processor, etc.

In addition, the cartridge is a developing cartridge or a process cartridge, for example. The cartridge is dismountably mounted to a main assembly of the electrophotographic image forming apparatus, and contributes to an image formation process for forming the image on the recording material. Here, the developing cartridge has a developing roller and contains developer (toner) for developing an electrostatic latent image formed on the electrophotographic photosensitive member drum by the developing roller. The developing cartridge is dismountably mounted to the main assembly. The process cartridge includes the developing roller as the process means, and the electrophotographic photosensitive member drum integrally and is dismountably mounted on the main assembly.

The cartridge is mounted and demounted relative to the main assembly by the user itself. Therefore, the maintenance of the electrophotographic image forming apparatus is carried out easily.

When the cartridge is dismountably mounted on the main assembly, a coupling member receives a rotational force from the main assembly.

On the recording material, the image is formed by the electrophotographic image forming apparatus and the recording material is the paper and the sheet OHP, for example.

The main assembly is a structure provided by omitting the structure of the cartridge from the structure of the electrophotographic image forming apparatus.

BACKGROUND OF THE INVENTION

Heretofore, a color electrophotographic image forming apparatus for forming a multicolor image by an electrophotographic type is known. In the image forming apparatus the drum-shaped electrophotographic photosensitive member (photosensitive drum or drum) uniformly charged by a charging device is selectively exposed to form a latent image. The cartridges which contain the developers of the different colors are supported by a rotary member. The cartridge which contains the developer of the predetermined color is opposed relative to the photosensitive drum by a rotation of the rotary member to develop the latent image into a developed image. The developed image is transferred onto the recording material. The transfer operation of the developed image is carried out for each color. By this, the color image is formed on the recording material.

In the developing cartridge, the structure that a side cover is secured on a frame by a screw or screws is known. The method in which the side cover is dismounted from the frame by removing a screw is known. (Japanese Laid-open Patent Application 2007-241186).

SUMMARY OF THE INVENTION

In the cartridge, in mounting the side cover to the cartridge frame, to improve the mounting operativity is desired.

The principal object of the present invention is providing a cartridge with which a mounting operativity in mounting the side cover and the bearing member to the cartridge frame is improved.

Another object of the present invention is to provide a cartridge wherein a mounting operativity is improved in mounting the side cover and the bearing member to the cartridge frame.

A further object of the present invention is to provide an assembling method for a cartridge wherein a mounting operativity is improved in mounting the side cover and the bearing member to the cartridge frame.

The further object of the present invention is to provide a disassembling method for a cartridge wherein a mounting operativity is improved in mounting the side cover and the bearing member to the cartridge frame.

According to an aspect of the present invention, there is provided a cartridge detachably mountable to a main assembly of an electrophotographic image forming apparatus, said cartridge comprising a developer accommodating portion for accommodating a developer; a developing roller for developing an electrostatic latent image formed on an electrophotographic photosensitive drum with the developer accommodated in said developer accommodating portion; a cartridge frame extended in a longitudinal direction of said developing roller; a bearing member, provided at one longitudinal end portion of said cartridge frame, for supporting a developing roller shaft portion at one longitudinal end portion of said developing roller; a rotational force receiving member for receiving, from the main assembly, a rotational force for rotating said developing roller, in a state in which said cartridge is mounted to the main assembly; a side cover provided outside said bearing member with respect to a longitudinal direction of said cartridge frame; a first fastening member fastening said bearing member to said cartridge frame to mount said bearing member to said cartridge frame; and a second fastening member fastening said side cover to said cartridge frame to mount said side cover to said cartridge frame.

According to the present invention, in mounting the side cover and the bearing member to the cartridge frame in the cartridge, the mounting operativity can be improved.

According to the present invention, in dismounting the side cover and the bearing member from the cartridge frame in the cartridge, the removal operativity can be improved.

According to the present invention, the assembling method for the cartridge wherein in mounting the side cover and the bearing member to the cartridge frame mount and the operativity is improved can be provided in the cartridge.

According to the present invention, the disassembling method for the cartridge wherein the dismounting operativity is improved in dismounting the side cover and the bearing member from the cartridge frame can be provided in the cartridge.

These and other objects, features, and advantages of the present invention will become more apparent upon consideration of the following description of the preferred embodiments of the present invention, taken in conjunction with the accompanying drawings.

EMBODIMENTS OF THE PRESENT INVENTION (First Embodiment)

(Cartridge)

Figure 1:
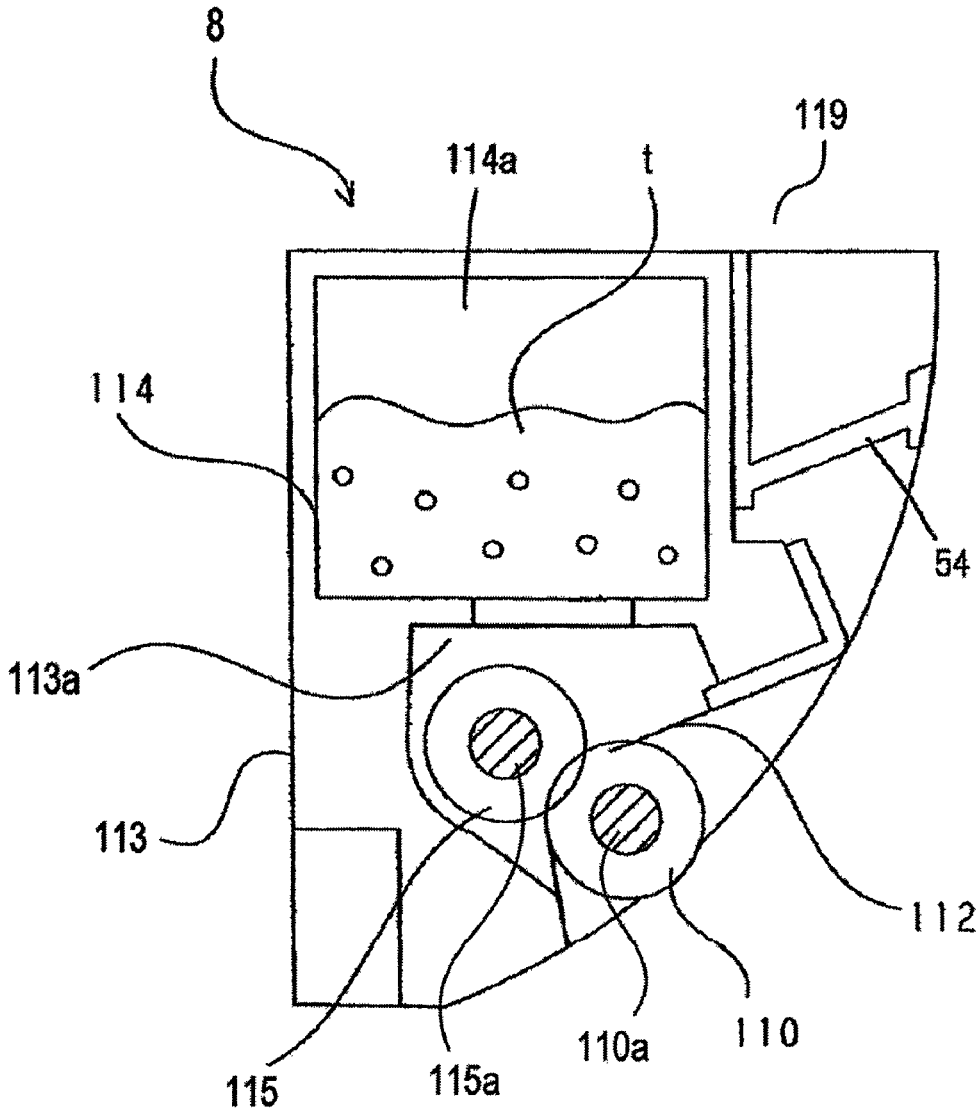
FIG. 1 is a side sectional view of a cartridge according to an embodiment of the present invention.
Figure 2:
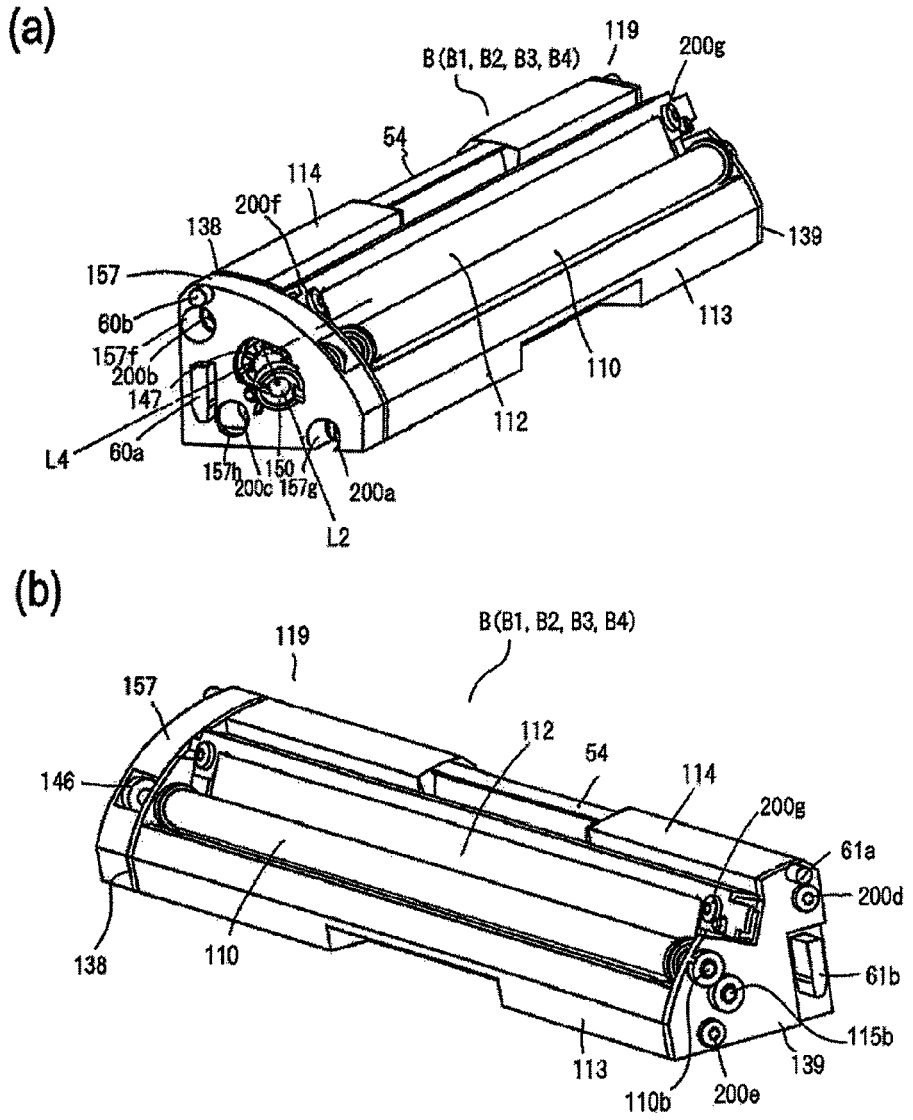
FIG. 2 is a perspective view of the cartridge according to the embodiment of the present invention.
Figure 3:
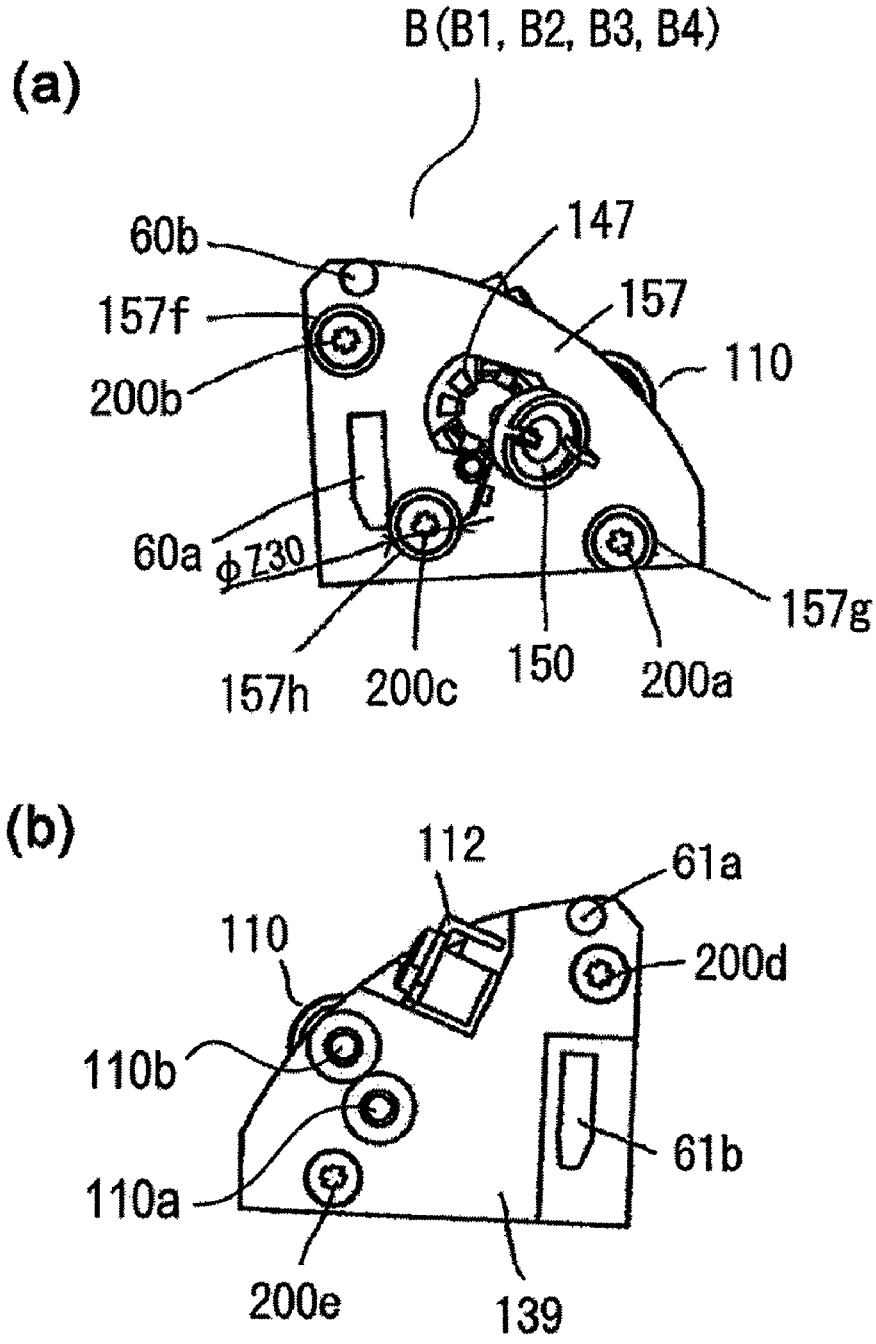
FIG. 3 is a perspective view of the cartridge according to the embodiment of the present invention.
Figure 4:
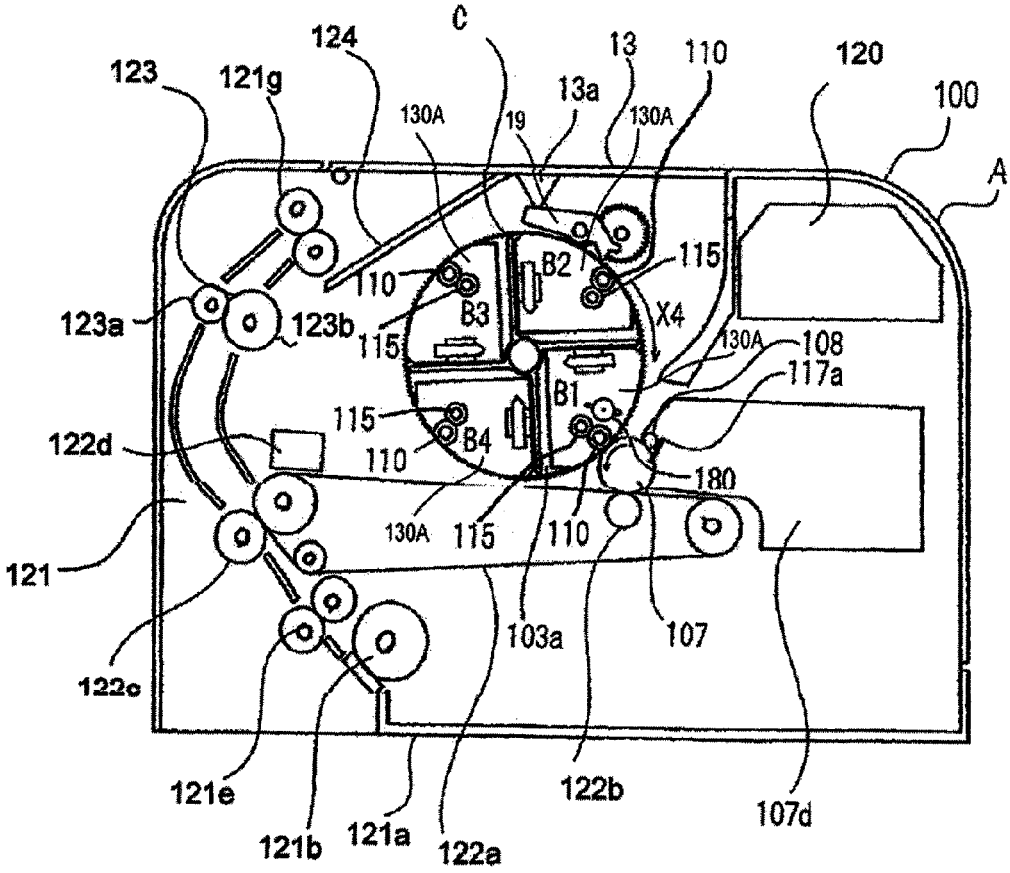
FIG. 4 is a side sectional view of the main assembly of an electrophotographic image forming apparatus according to an embodiment of the present invention.

First, referring to FIG. 1-FIG. 4, the developing cartridge B ("cartridge") as a developing device according to a first embodiment will be described. FIG. 1 is a sectional view of the cartridge B. FIG. 2 is a perspective view of the cartridge B. FIG. 3 is a side view of a cartridge B, as seen from a driving side with respect to a direction of the axis of a developing roller and a side view, as seen from a non-driving side. In addition, FIG. 4 is a sectional view of a main assembly A of a color electrophotographic image forming apparatus 100*a*.

The cartridge B is mountable and dismountable relative to the rotary C (main assembly A) provided in the main assembly A by the user.

In FIG. 1-FIG. 3, the cartridge B includes a developing roller 110. The developing roller 110 receives the rotational force through the coupling mechanism as will be described hereinafter from the main assembly A at the time of the developing action to rotate.

The developer t of the predetermined color is contained in a developer accommodating portion 114 of the cartridge B. The developer is supplied onto the developing roller 110 surface by the rotation of the sponge-like developer supply roller 115 in the developer chamber 113*a*. And, the developer t is triboelectrically charged and formed into a thin layer by the friction between a developing blade 112 for regulating the thickness of the developer supplied to the developing roller 110 and the developing roller 110. The thin layer of the developer on the developing roller 110 is fed to a developing position by the rotation. An electrostatic latent image formed on an electrophotographic photosensitive member drum (the photosensitive drum or the drum) 107 is developed by applying a predetermined developing bias to the developing roller 110. In other words, the electrostatic latent image is developed by the developing roller 110.

The developer which has not contributed to the development of the latent image, i.e., the developer which remains on the surface of the developing roller 110, is removed by the developer supply roller 115. Simultaneously therewith, the supply roller 115 supplies the new developer onto the surface of the developing roller 110. By this, the developing operation is carried out continuously. The developing roller 110 develops the electrostatic latent image formed on the photosensitive drum 107 with the developer t contained in the developer accommodating portion 114*a*. In addition, a supply roller 115 supplies the developer t to the developing roller 110.

The cartridge B has a development unit 119. The development unit 119 has a developing device frame 113. In addition, the development unit 119 has the developing roller 110, the developing blade 112, a supply roller 115, a developer chamber 113*a*, and the developer accommodating portion 114. In addition, the developing roller 110 is rotatable about an axis L1 (FIG. 10 (*a*)).

The developing roller 110 and the supply roller 115 are supported rotatably in the shaft portion 110*a* and the shaft portion 115*a* by a bearing members (first bearing members) 138. The shaft portion 110*b* and the shaft portion 115*b* are supported rotatably by bearing members (second bearing members) 139 at the opposite side. The bearing member 138 is secured by screws 200*b*, 200*c* to the developing device frame 113. In addition, the bearing member 139 is secured by the fourth screw (fourth fastening portion) 200*d* and the fifth screw (fifth fastening portion) 200*e* to the developing device frame 113. By this, the developing roller 110 and the supply roller 115 are supported rotatably by the developing device frame (cartridge frame) 113 through the bearing members 138, 139. The frame 113 is extended along the longitudinal direction of the developing roller 110. The bearing member 138 is provided at the driving side (coupling side) with respect to the longitudinal direction of the frame 113. The bearing member 139 is provided at side) which does not have the non-driving side (coupling 150 with respect to the longitudinal direction of the frame 113. The bearing member (first bearing member) 138 is provided at said one longitudinal end portion of the frame 113. The bearing member 138 supports one-end shaft portion (developing roller shaft portion) 110*a* provided at said one longitudinal end portion of the developing roller 110 and supports one-end shaft portion (developer supply roller shaft portion) 115*a* provided at said one longitudinal end portion of the supply roller 115. In addition, the bearing member (second bearing member) 139 is provided at the other longitudinal end portion of the frame 113. It supports the other end shaft portion (developing roller shaft portion) 110*b* provided at the other longitudinal end portion of the developing roller 110 and supports the other end shaft portion (developer supply roller shaft portion) 115*b* provided at the other longitudinal end portion of the supply roller 115.

Here, the cartridge B is dismountably mounted to the cartridge accommodating portion 130A provided in the developing rotary member C by the user. The rotary member C is provided in the main assembly A. As will be described hereinafter, the connection between a drive shaft 180 provided in the main assembly A and a coupling member (the rotational force transmitting part) 150 of the cartridge B is established in interrelation with the operation of positioning the cartridge B to the predetermined position (photosensitive drum opposing portion) by the rotary member C. And, the developing roller 110 and the supply roller 115 receives the rotational forces from the main assembly A to rotate.

(Electrophotographic Image Forming Apparatus)

Referring to FIG. 4, a color electrophotographic image forming apparatus 100 with which the cartridge B is used will be described. The color laser beam printer is taken as an example of the image forming apparatus 100.

As shown in FIG. 4, the plurality of cartridges B (B1, B-2, B3, B4) containing the developers (toner) of the different colors are mounted to the rotary member C (accommodating portion 130A, FIG. 4). In addition, the mounting and dismounting of the cartridge B relative to the rotary member C is carried out by the user. The cartridge B containing the developer of a predetermined color is opposed to the photosensitive drum 107 by rotating the rotary member C. The electrostatic latent image formed on the photosensitive drum 107 is developed. The thus formed developed image is transferred onto a transfer belt 122*a*. These operations are carried out for each color. By this, a color image is provided. The detailed description will be made. Here, the recording material S is paper, OHP sheet, and so on which image can be formed.

As shown in FIG. 4, a laser beam based on image information from optical means 120 is projected onto the drum 107. By this, an electrostatic latent image is formed on the drum 107. This latent image is developed by the developing roller 110 with the developer t. The developer image formed on the drum 107 is transferred onto the intermediary transfer belt (the intermediary transfer member) 122*a*.

Then, the developer image transferred onto the transfer belt 122*a* is transferred onto the recording material S by a secondary transfer roller (second transferring means) 122*c*. The recording material S onto which the developer image has been transferred is fed to the fixing means 123 which has a pressing roller 123*a* and a heating roller 123*b*. The developer image transferred onto the recording material S is fixed on the recording material S by the fixing means 123. After the image fixing, the recording material S is discharged to the tray 124.

The image formation step will further be described.

The drum 107 is rotated in the counterclockwise direction in synchronism with the rotation of the transfer belt 122*a* (FIG. 4). The drum 107 surface is uniformly charged by the charging roller 108. The light of the yellow image, for example is projected in response to the image information by the exposure means 120. By this, a yellow electrostatic latent image is formed on the drum 107. In this manner, the electrostatic latent image corresponding to the image information is formed on the drum 107.

The rotary C is rotated simultaneously with the formation of the latent image. By this, the yellow cartridge B1 is moved to the developing position. A predetermined bias voltage is applied to the developing roller 110. By this, the yellow developer is deposited on the latent image. In this manner, the latent image is developed by the yellow developer. Thereafter, the bias voltage of the polarity contrary to the developer is applied to the confining roller (primary transfer roller) 122*b* for the transfer belt 122*a*. In this manner, the yellow developer image transfers primarily onto the transfer belt 122*a* from the photosensitive drum 107. The developer which remains on the photosensitive drum 107 is removed by a cleaning blade 117*a*. The removed developer is collected into a developer box 107*d*.

When the primary transfer of the yellow developer image described above is finished, the rotary C is rotated. By this, the next cartridge B-2 is moved to the position opposed to the drum 107. These steps are executed for the magenta cartridge B-2, the cyan cartridge B3, and the black cartridge B4. The four color developer images are overlaid on the transfer belt 122*a* by the repetition for the magenta, cyan and the black colors.

The cartridge B1 contains the yellow developer and forms the yellow developer image. The cartridge B-2 contains the magenta developer and forms the magenta developer image. The cartridge B3 contains the cyan developer and forms the cyan developer image. The cartridge B4 contains the black developer and forms the black developer image. The structures of the cartridges B are the same.

After the four color developer image is formed on the transfer belt 122*a*, the transfer roller 122*c* is press-contacted onto the transfer belt 122*a* (FIG. 4). The recording material S which stands by in the predetermined position adjacent to the registration roller couple 121*e* is fed into a nip between the transfer belt 122*a* and the transfer roller 122*c* in synchronism with the press-contact of the transfer roller 122*c*. Simultaneously, the recording material S is fed from the cassette 121*a* by the feeding roller 121*b* and the registration roller couple 121*e* as the feeding means 121.

In addition, the bias voltage of the opposite polarity to the developer is applied to the transfer roller 122*c*. By this, the developer images on the transfer belt 122*a* are transferred secondarily all together onto the fed recording material S. A charging roller 122*d* removes the developer deposited on the belt 122*a*.

The recording material S onto which the developer image has been transferred is fed to fixing means 123. The fixing of the developer image is carried out there. And, the recording material S having been subjected to the fixing operation is discharged to the discharging tray 124 by discharging roller pair 121*g*. By this, the image formation is completed on the recording material S.

The rotary member C is provided with a plurality of cartridge accommodating portions 130A. In the state that the cartridges B are mounted to this accommodating portion, the rotary member C unidirectionally rotates. By this, the coupling member 150 (as will be described hereinafter) of the cartridge B couples (engage) with a drive shaft (the main assembly driving shaft) 180 provided in the main assembly A, and disengages from the drive shaft 180. The developing roller 110 of the cartridge B contained in the accommodating portion 130A is moved in the direction substantially perpendicular to the direction of an axis L3 of the drive shaft 180 in response to movement, in one direction, of the rotary member C. In other words, the axis L1 of the developing roller 110 moves in the direction substantially perpendicular to the axis L3 by the rotation of the rotary C.

(Rotational-Driving-Force-Transmitting Mechanism)

A development gear (rotational-driving-force-transmitting member) 145 is provided on a shaft portion (the rotation shaft) 110*a* of the developing roller 110. A supply roller gear (rotational-driving-force-transmitting member) 146 is provided at a shaft portion (rotation shaft) 115*a* of a supply roller 115. The rotational force received by the coupling (rotational force receiving member) 150 from the main assembly A is transmitted through the gears 145, 146 to the other rotatable members of the cartridge B (developing roller 110, supply roller 115, and so on). In the state that the cartridge B is mounted to the main assembly A, the coupling 150 receives the rotational force for rotating the developing roller 110 from the main assembly A. In addition, the rotational force for rotating the supply roller 115 is received. The gear 145 is provided in the outside of the bearing member 138 with respect to the longitudinal direction in said one longitudinal end portion of the frame 113, and transmits the rotational force received from the main assembly A by the coupling 150 to the developing roller 110. In addition, the rotational-driving-force-transmitting member may not be limited to the gear, but may be a toothed belt, for example. However, the gears are advantageous in the compactness and the mounting easiness'.

A cylindrical member (FIG. 5, FIG. 7, FIG. 8, FIG. 9) 147 which supports the coupling 150 will be described.

Figure 5:
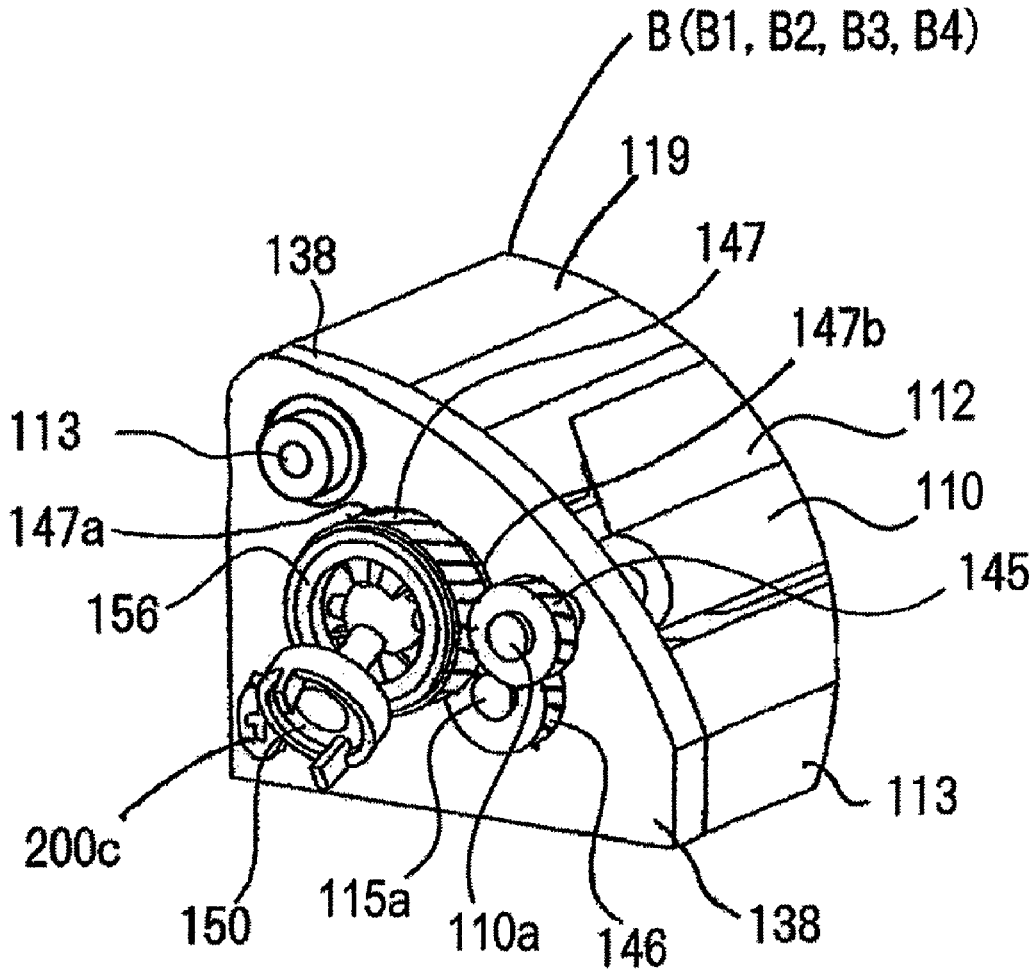
FIG. 5 is a perspective view of the coupling and the driving train according to an embodiment of the present invention.

As shown in FIG. 5, the cylindrical member 147 is mounted rotatably in the position in which the development gear 145 and the gear portion (first gear) 147*a* and the supply roller gear 146 and the gear portion (second gear) 147*b* engage, respectively. The cylindrical member 147 has a coupling accommodating portion 147*j* (FIG. 7 (*b*)), which accommodates the driving portion 150*b* of the coupling 150.

Figure 7:
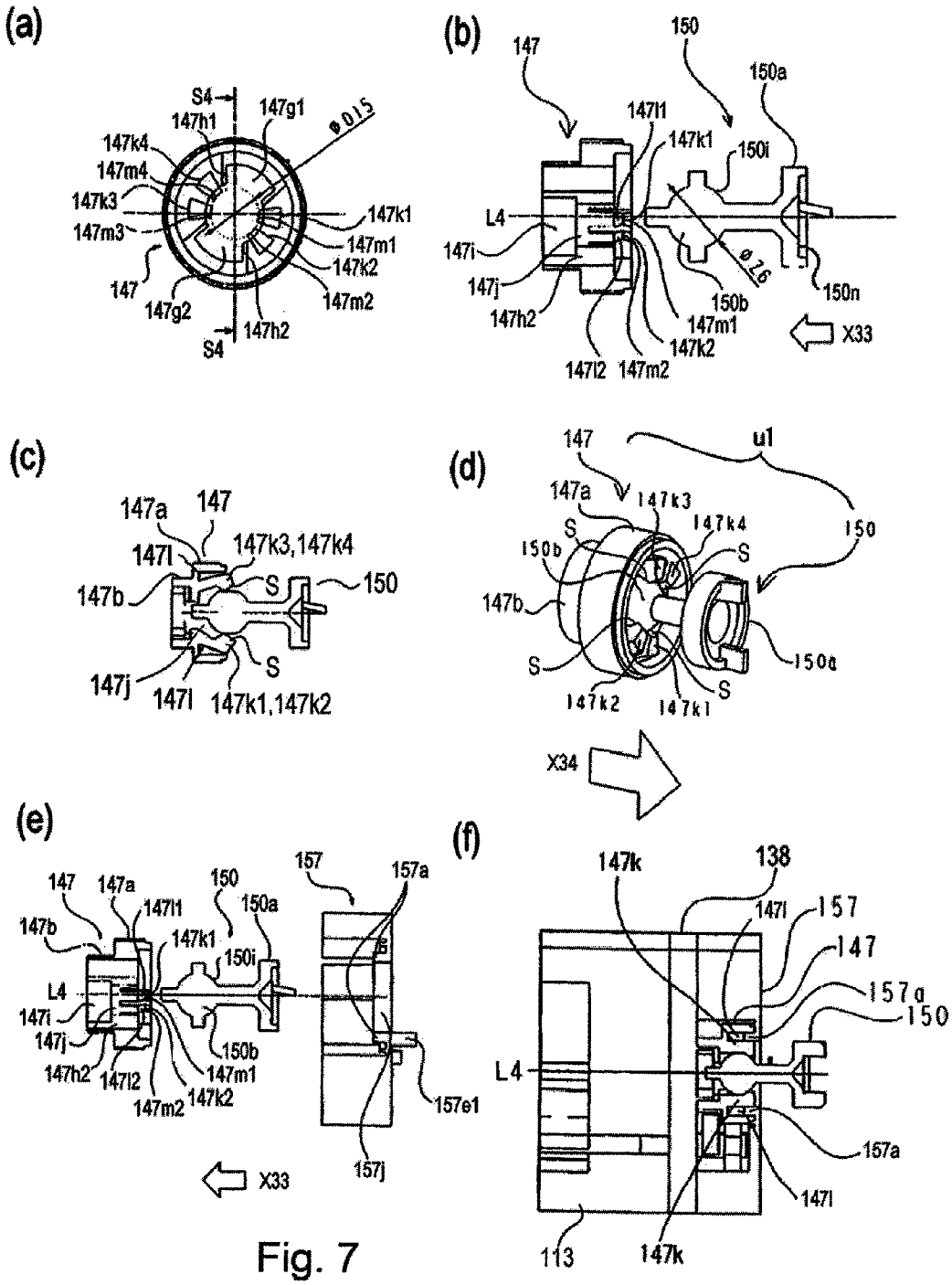
FIG. 7 is a front view and a side sectional view of a drive unit according to an embodiment of the present invention.
Figure 8:
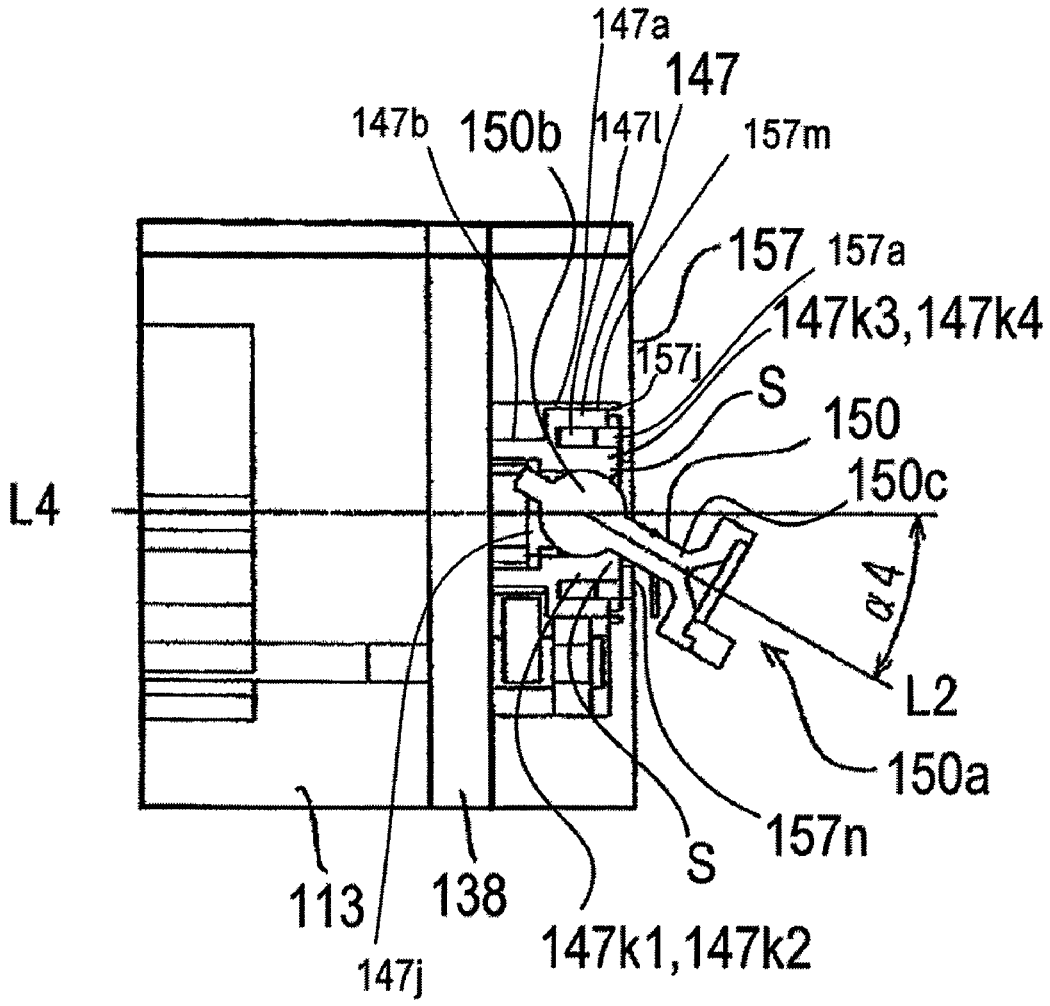
FIG. 8 is a sectional view of a cartridge according to an embodiment of the present invention.

The coupling 150 is restricted in the movement in a direction of an arrow X34 in FIG. 7 (*d*) relative to the cylindrical member 147, by the retaining portions 147*k*1, 147*k*2, 147*k*3 and 147*k*4 of the cylindrical member 147, and it is pivotably mounted to the cylindrical member 147 (FIG. 8).

A side cover (side member) 157 is mounted in the direction of the axis L1 of the developing roller 110 (longitudinal direction) (FIG. 2 (*a*) and FIG. 3). At this time, a third screw (third fastening member) 200*b* is mounted to the developing device frame 113 through the side cover 157 and the bearing member 138. By this, the side cover 157 and the bearing member 138 are fastened together to the developing device frame 113. The screw 200*b* is secured to a screw seat 114*d* (FIG. 10) provided on the developing device frame 113 through the side cover 157 and the bearing member 138. In this manner, the side cover 157 is directly fixable to the developing device frame 113 through the bearing member 138. The side cover 157 is provided on the outside of the bearing member 138 with respect to the longitudinal direction of the frame 113 (the longitudinal direction of the developing roller 110). The side cover 157 covers the gears 145, 146 (the rotational-driving-force-transmitting member) and the gear portion (the gear and the rotational-driving-force-transmitting member) 147*a*, 147*b*. In this manner, between the itself and the bearing member 138, the side cover 157 covers the gear 145 for transmitting the rotational force received from the main assembly A to the developing roller 110 by the coupling 150 at said one longitudinal end portion of the frame 113. Therefore, since the gear 145 is positioned between the bearing member 138 and the side cover 157, the assembling operation is easy. By this, the contact, with the other member, of the gears 145, 146 and the gear portion 147*a*, 147*b* is prevented. In addition, the inadvertent contact by the user to these can be prevented. However, the side cover 157 may not necessarily cover the gear completely. For example, the gear may intermittently be covered, or only a part of the gear may be covered. Such a structure is included in the present embodiment. The cylindrical member 147 supports movably the driving portion 150*b* (the one-end portion) of the coupling 150 therein. The inside of the cylindrical member 147 is provided with the rotational force reception surface (cylinder side force receiving portion) 147 (147*h*1 or 147*h*2) for receiving the rotational force received from the main assembly A by the coupling 150. In addition, the outer surface of the cylindrical member 147 is provided with the gear (first gear) 147*a* for transmitting the rotational force received by the rotational force reception surface 147 to the developing roller 110. The cartridge B is provided with the gear 145 (the rotational-driving-force-transmitting member, second gear) on the shaft portion 110*a*. Therefore, in the state that the cartridge B is mounted to the main assembly A, the rotational force from the drive shaft 180 of the main assembly A is transmitted to the developing roller 110 through the coupling 150, the cylindrical member 147, the gear 147*a*, and the gear 145. By this, the developing roller 110 is rotated. According to this embodiment, the cylindrical member 147 itself which supports the coupling 150 is provided with the gear 147*a*, 147*b*. Therefore, the rotational force received by the cylindrical member 147 through the coupling 150 can be efficiently transmitted to the developing roller 110 and the supply roller 115. In addition, the rotational force transmission structure can be compact.

Figure 13:
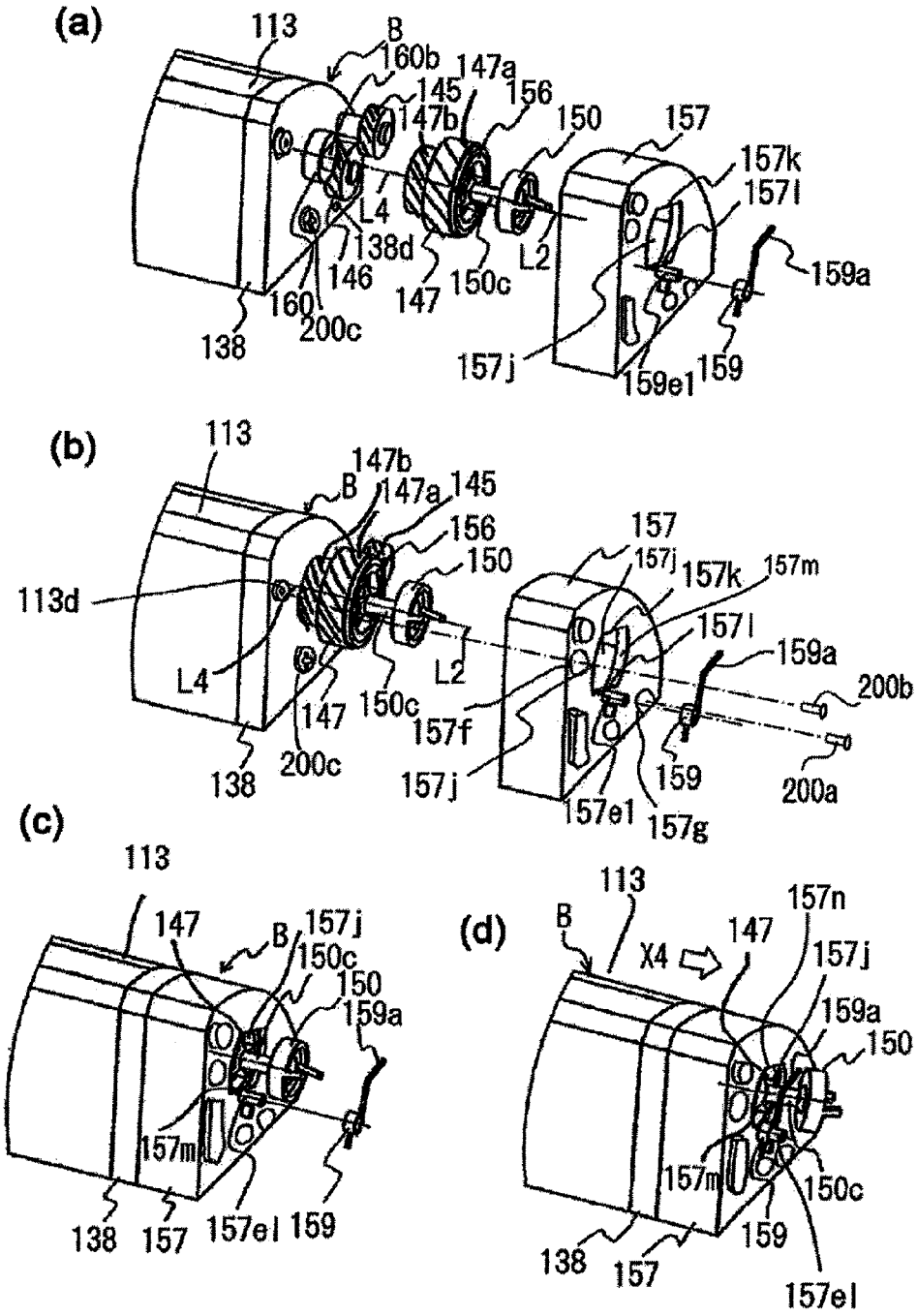
FIG. 13 is a perspective view illustrating the assembling method for the cartridge drive portion according to an embodiment of the present invention.

The side cover 157 is provided with the hole 157*j*, and the inner surface 157*m* thereof engages with the cylindrical member 147 (FIG. 5, FIG. 7 (*e*), FIG. 8, and FIG. 13).

(Rotational Force Transmitting Part (Coupling and Coupling Member)

Figure 6:
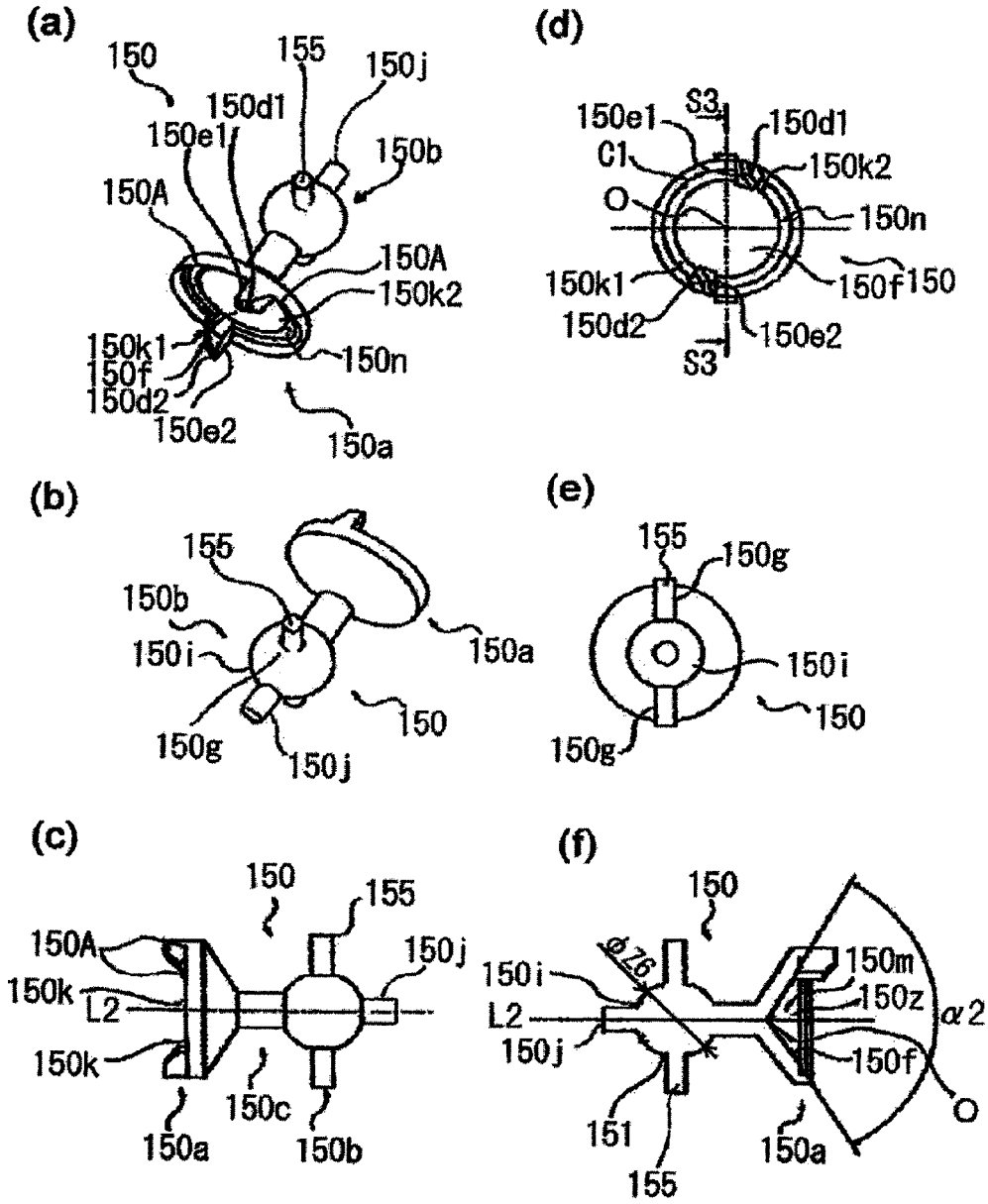
FIG. 6 is a perspective view of the coupling according to the embodiment of the present invention.

Referring to FIG. 6, the description will be made as to an example of the coupling as the rotational force transmitting part which is one of major constituent-elements of the present embodiment (coupling member and rotational force receiving member). FIG. 6 (*a*) shows a perspective view of the coupling, as seen from the main assembly side and FIG. 6 (*b*) shows a perspective view of the coupling, as seen from the developing roller side. In addition, FIG. 6 (*c*) is a view as seen in the direction perpendicular to the direction of the rotation axis L2 of the coupling. In addition, FIG. 6 (*d*) is a side view of the coupling, as seen from the main assembly side, and FIG. 6 (*e*) is a view of the coupling, as seen from the developing roller side. In addition, FIG. 6 (*f*) is the S3 sectional view of the structure shown in FIG. 6 (*d*).

The cartridge B is dismountably mounted to the accommodating portion 130A. This is carried out by the user. And, the rotary member C is rotated in response to a control signal. When the cartridge B reaches the predetermined position (developing position which is opposed to the photosensitive drum 107), the rotary member C is stopped. By this, the coupling 150 engages with the drive shaft 180 provided in the main assembly A.

The cartridge B is moved from the predetermined position (the developing position) by further rotating the rotary member C in the same direction. More particularly, it is retracted from the predetermined position. By this, the coupling 150 is disengaged from the drive shaft 180.

In the state of the engagement with the drive shaft 180, the coupling 150 receives the rotational force from a motor provided in the main assembly A (unshown). And, the rotational force thereof is transmitted to the developing roller 110. By this, the developing roller 110 is rotated by the rotational force received from the main assembly A. The transmission of the rotational force is accomplished through the coupling s 150, the rotational force receiving surfaces (cylinder side force receiving portion and the rotational force receiving portion) 147 (147*h* 1 or 147*h*2), the gear portion 147*a*, and the gear 145. The rotational force is transmitted through the pin (rotational force transmitting portion) 155 to the rotational force reception surface 147. The rotational force is transmitted through the gear portion 147*b* and the gear 146 to the supply roller 115.

Figure 19:
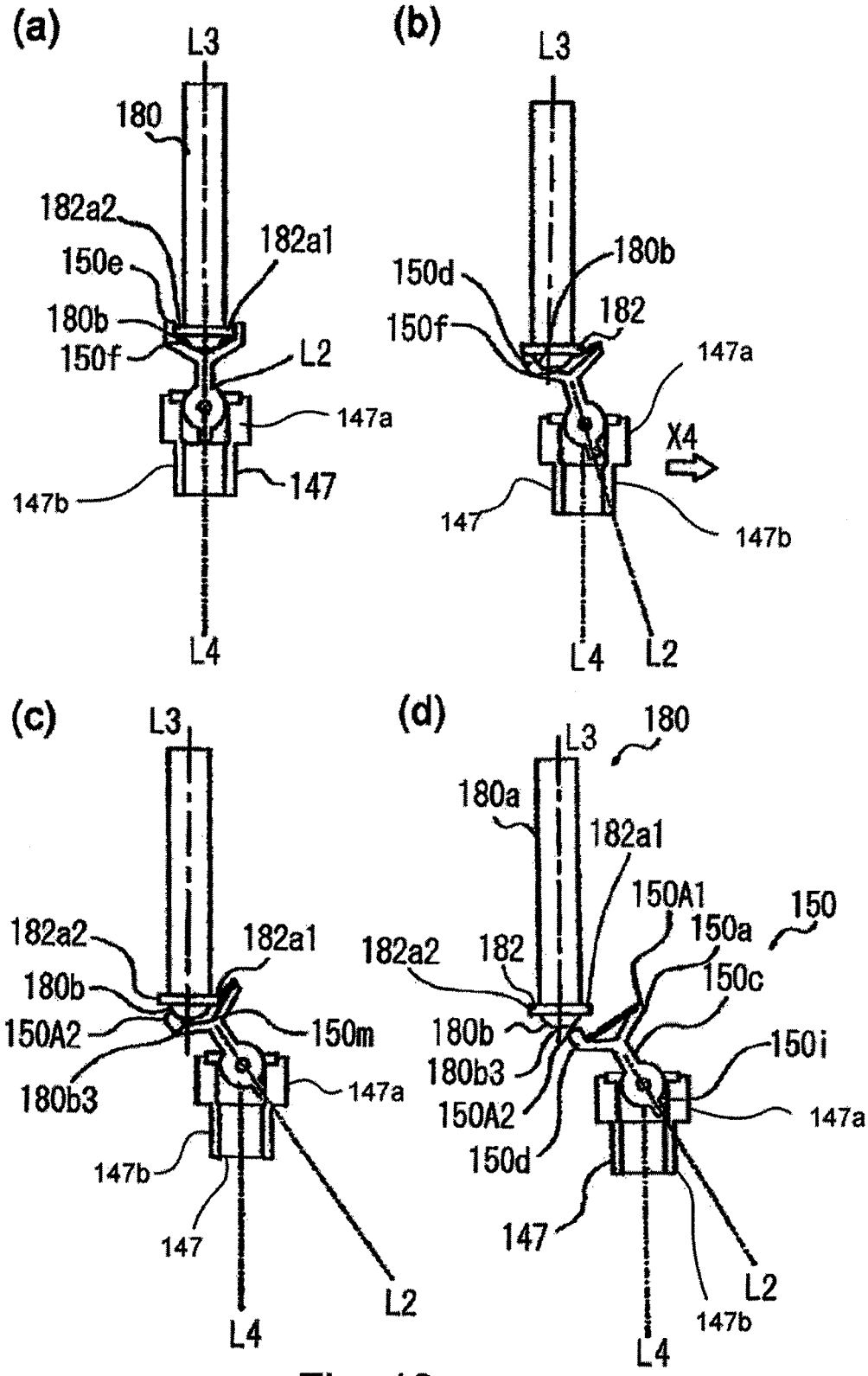
FIG. 19 is a longitudinal sectional view illustrating a disengagement process between the drive shaft and the coupling according to an embodiment of the present invention.

As has been described hereinbefore, the drive shaft 180 has the pins 182 (rotational force applying portion) (FIG. 19 (*a*)), and is rotated by the motor (unshown).

In addition, the material of the coupling 150 is desirably the resin material (polyacetal, for example).

The coupling 150 has three main parts, as shown in FIG. 6 (*c*). A first portion is a driven portion 150*a*, and engages with the drive shaft 180 (as will be described hereinafter) to receive the rotational force from the rotational force transmitting pins 182 which are the rotational force applying portion (main assembly side rotational force transmitting portion) provided on the drive shaft 180. A second portion is a driving portion 150*b*, wherein the pins 155 engage with the cylindrical member 147 to transmit the rotational force. A third portion is an intermediate part 150*c*, and connects the driven portion 150*a* and the driving portion 150*b* relative to each other.

As shown in FIG. 6 (*f*), the driven portion 150*a* has the drive shaft insertion opening portion 150*m* which expands away from the rotation axis L2. The driving portion 150*b* has a spherical driving shaft receiving surface (spherical portion) 150*i*, a driving force transmission part (the projection) 155, and a coupling regulating portion 150*j*. The transmitting portion 155 has the function of transmitting the rotational force received from the main assembly A by the coupling 150 to the cylindrical member 147, and projects in a radial direction of the cylindrical member 147. The regulating portion 150*j* is substantially co-axial with the axis L2, and engages with a regulation accommodating portion 160*b* (FIG. 10 (*b*)), as will be described hereinafter. In this manner, the regulating portion 150*j* regulates the axis L2 of the coupling.

The opening 150*m* is formed by a driving shaft receiving surface 150*f* of the configuration of the conical shape expanded toward the drive shaft 180. The receiving surface 150*f* constitutes a recess 150*z*, as shown in FIG. 6 (*f*). The recess 150*z* has the opening 150*m* in the opposite side to the cylindrical member 147 in the direction of the axis L2.

Figure 22:
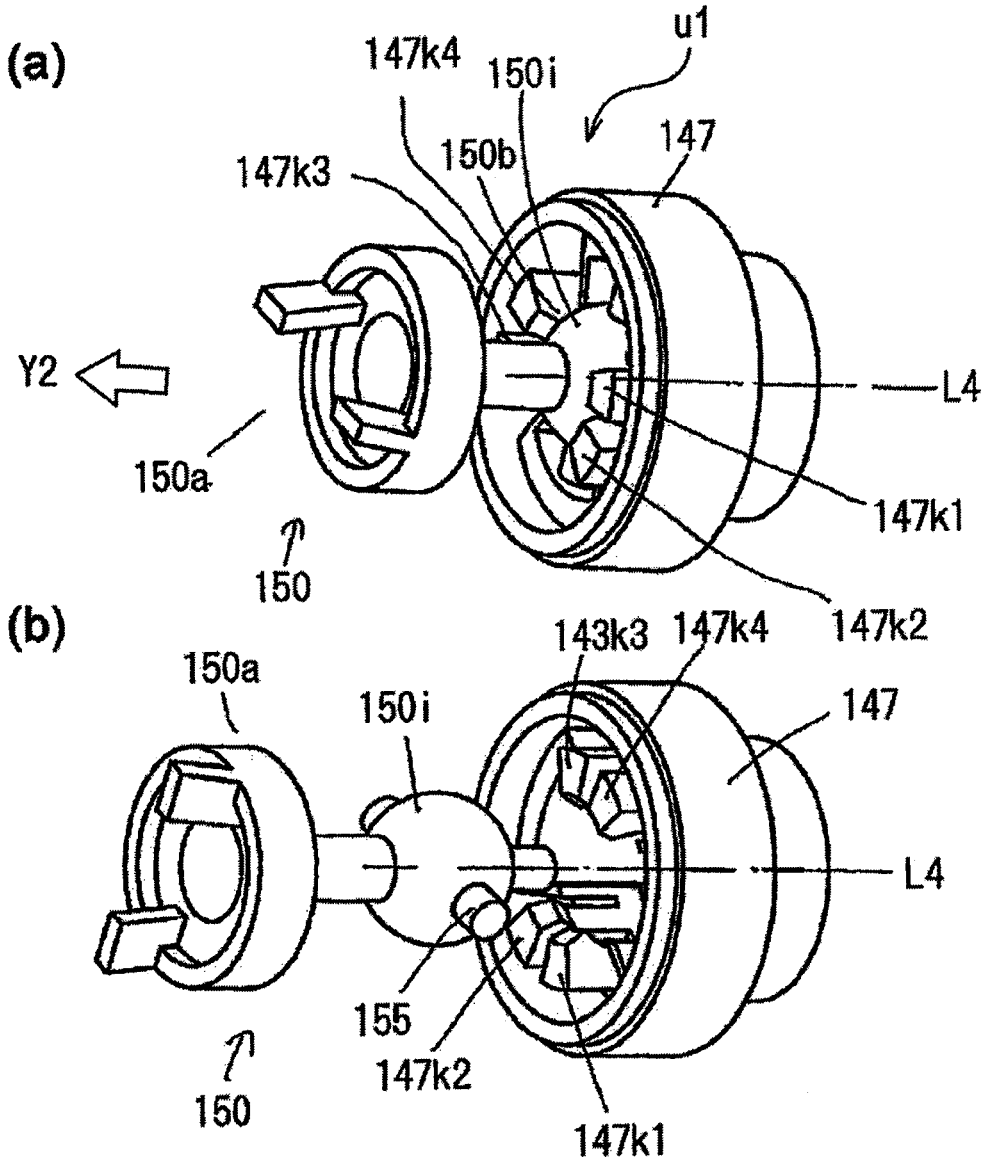
FIG. 22 is a perspective view of a drive unit according to an embodiment of the present invention.

By this, the coupling 150 can move between a pre-engagement angular position (FIG. 19 (*a*)) and a rotational force transmitting angular position (FIG. 19 (*d*)) and between the rotational force transmitting angular position and a disengaging angular position (FIG. 22 (*c*), and (*d*)) relative to the axis L3 of the drive shaft 180, irrespective of the rotational phase of the developing roller 110 in the cartridge B. More particularly, the coupling 150 can be moved (pivoted and revolved) between these positions, without prevention by the free end portion 182*a* of the drive shaft 180.

And, the two projections and engaging portions 150*d* (150*d* 1 or 150*d*2) are disposed at equal intervals on the circumference having a center on the axis L2 in the end surface of the recess 150*z*. In addition, the entrance portions are provided between the adjacent projections 150*d* 150*k* (150*k*1, 150*k*2). An interval between the projections 150*d* 1 or 150*d*2 is larger than the outer diameter of the pin 182 so that the pin 182 provided on the drive shaft 180 can be received thereby. The pin 182 is the rotational force transmitting portion. The portions between these projections are the entrance portions 150*k*1, 150*k*2.

When the rotational force is transmitted to the coupling 150 from the drive shaft 180, the pins 182 are in the entrance portions 150*k*1, 150*k*2. In FIG. 6 (*d*), there are rotational force receiving surfaces (rotational force receiving portions) 150*e* (150*e*1, 150*e*2) in the upstream side of each projection 150*d* with respect to clockwise direction. The receiving surface 150*e* cross with the rotational direction of the coupling 150. The projection 150*d*1 is provided with a receiving surface 150*e*1, and the projection 150*d*2 is provided with the receiving surface 150*e*2. The pins 182*a*1, 182*a*2 contact to either of the receiving surfaces 150*e* in the state that the drive shaft 180 rotates. By this, the receiving surface 150*e* contacted by the pin 182*a*1, 182*a*2 is pushed by the pin 182. This rotates the coupling 150 about the axis L2.

The receiving surface 150*f* has a conical configuration which has an apex angle of $\alpha 2$ degree, as shown in FIG. 6 (*f*). Therefore, the coupling 150 and the drive shaft 180 engage with each other. When the coupling 150 is in the rotational force transmitting angular position, the free end 180*b* (FIG. 19 (*a*)) of the drive shaft contacts to the receiving surface 150*f*. And, the axis of the conical shape, i.e., the axis L2 of the coupling 150, and the axis L3, (FIG. 21) of the drive shaft 180 are substantially co-axial with each other. In other words, the coupling 150 and the drive shaft 180 align with each other and the torque transmitted to the coupling 150 is stabilized.

In this embodiment, angle $\alpha 2$ is 60-150 degrees. Depending on the angle of $\alpha 2$, the non-conical portion 150*n* (FIG. 6 (*a*), FIG. 6 (*d*)) of the opening 150*m* is wide (FIG. 7 (*b*)) or nothing. In addition, in this embodiment, although the receiving surface 150*f* is conical, it may be cylindrical, bell-like or horn-like in configuration.

It is desirable to dispose the receiving surface 150*e* on the phantom circle (the same circumference) C1 which has the center O on the axis L2 (FIG. 6 (*d*)). By doing so, the rotational force transmission radius is constant, so that the torque transmitted is stabilized. As to the projections 150*d*, it is preferable that the position of the coupling 150 is stabilized by the balance of the forces received by the coupling 150. For this reason, in this embodiment, the receiving surfaces are disposed in the diametrically opposed positions 150*e* (180 degrees).

More particularly, in this embodiment, the receiving surface 150*e*1 and the receiving surface 150*e*2 are opposed to each other. For this reason, the forces received by the coupling 150 are a force couple. For this reason, the coupling 150 can continue rotary motion with the force couple. In this manner, coupling 150 can be rotated without the special regulation of the position of the rotation axis L2.

The projection 150*d* is provided at the free end portion of the recess 150*z*. The two projections (the projection) 150*d* project in the crossing direction crossing with the rotational direction of the coupling 150, and are provided with a gap from each other along the rotational direction. In engaging with the rotating drive shaft as will be described hereinafter by the two projections 150*d*, the assured engagement is accomplished.

In the state that the cartridge B is mounted to the rotary member C, the receiving surfaces 150*e* engage with the pins 182. And, they are pushed by the pin 182 of the rotating drive shaft 180. By this, the receiving surfaces 150*e* receive the rotational force from the drive shaft 180. In addition, the receiving surfaces 150*e* are provided at the positions which are equidistant from the axis L2 and which are diametrically opposed with respect to the axis L2, and they are provided on the surface faced in the crossing direction described above of the projections 150*d*.

In addition, the entrance portions (the recesses) 150*k* are provided, and they are extended along the rotational direction, and they are recessed in the direction of the axis L2. The entrance portions 150*k* are provided between the projection 150*d* and the projection 150*d*. In the case where the drive shaft 180 does not rotate, with the engagement between the coupling and the drive shaft 180 by) mounting to (rotary member C of the cartridge B, the pins 182 enter the entrance portions 150*k*. And, the receiving surfaces 150*e* are pushed by the pins 182 of the rotating drive shaft 180. In the case where the drive shaft 180 already rotates upon the engagement with the drive shaft 180 of the coupling, the pins 182 enter the entrance portions 150*k*, and the pins 182 push the receiving surfaces 150*e*. By this, the coupling 150 rotates.

The receiving surfaces 150*e* may be provided inside of the receiving surfaces 150*f*. Or, the receiving surfaces 150*e* may be provided at the positions outwardly away from the receiving surfaces 150*f* in the direction of the axis L2. In the case of disposing the receiving surfaces 150*e* inside of the receiving surfaces 150*f*, the entrance portion 150*k* is also provided inside of the receiving surface 150*f*.

More particularly, the entrance portions (recess) 150*k* are positioned between the projections 150*d* inside of the arc portions of the receiving surfaces 150*f*. In the case of disposing the receiving surfaces 150*e* at the outwardly away positions, the entrance portions (recesses) 150*k* are positioned between the projections 150*d*.

Here, the recess may be a hole penetrated in the direction of the axis L2 or a hole which has a bottom portion. More particularly, the recess should just be a space region which is between the projections 150*d*. And, what is necessary is just to be able to enter the region in the pin 182 in the state that the cartridge B is mounted to the rotary member C.

Since the driving portion 150*b* is a spherical surface, irrespective of the rotational phase of the cylindrical member 147 in the cartridge B, it can move between the rotational force transmitting angular position and the pre-engagement angular position (or the disengaging angular position) relative to the axis L4 (FIG. 9) of the cylindrical member 147. The driving portion 150*b* includes the spherical retaining portion 150*i* which has the axis L2 as its axis in the illustrated example. And, the transmitting portion is provided at the position passing through the center of the driving portion 150*b* (sphere portion). In addition, the a cylindrical coupling regulating portion 150*j* which has the axis L2 as its axis is provided on the driving portion 150*b* in the position opposed to the intermediate part 150*c*. The regulating portion 150*j* regulates the axis L2 by engaging with the regulation accommodating portion 160*b* (FIG. 10 (*b*)) which will be described hereinafter.

Although the coupling 150 has an integral structure as a whole in this embodiment, it may be provided by unifying substantially by connecting the driven portion 150*a*, the intermediate part 150*c*, and the driving portion 150*b*. In addition, the drive transmitting portion 155 may be parallel steel pins as an unintegral member. Various other divisions are possible, and, if the operation is integrally possible as the coupling, the way of division is not restrictive.

Referring to FIG. 7, the cylindrical member 147 for supporting the coupling 150 will be described.

The openings 147*g* 1 or 147*g*2 shown in FIG. 7 (*a*) is a groove extended in the direction of the rotation shaft of the cylindrical member 147. In mounting the coupling 150 the rotational force transmitting portion (the rotational force transmitting portion) 155 enters the openings 147*g* 1 or 147*g*2.

In FIG. 7 (*a*), the upstream side (clockwise direction) of the opening 147*g* 1 or 147*g*2 is provided with the rotational force receiving surfaces (cylinder side force receiving portion and the rotational force receiving portion) 147*h* (147*h* 1 or 147*h*2). The lateral side of the transmitting portion 155 of the coupling 150 contacts to the transmitting surface 147*h*. By this, the rotational force is transmitted to the developing roller 110.

As shown in FIG. 7 (*b*), the cylindrical member 147 is provided with a coupling accommodating portion 147*j* for accommodating the driving portion 150*b* of the coupling 150.

It is provided with a retaining portion 147*k* (147*k*1-147*k*4) for preventing the accommodated driving portion 150*b* of the coupling 150 from being dislodged from the cylindrical member 147. The receiving surface 147*h*, the retaining portion 147*k*, and so on of the cylindrical member 147 are made of resin material, and they are integrally molded.

FIG. 7 (*b*) and FIG. 7 (*c*) are sectional views illustrating the coupling mounting step for mounting the coupling 150 to the cylindrical member 147.

First, the coupling 150 is moved in the direction of the arrow X33, to insert the driving portion 150*b* into the accommodating portion 147*j*. Before the insertion, a diameter Z6 of the retaining portion 150*i* is larger than a diameter D15 (FIG. 7 (*a*)) of the circle constituted by the inside edge line 147*m* (147*m*1-147*m*4) of the retaining portion 147*k*. More particularly, the relation of Z6>D15 is satisfied.

The retaining portion (first regulating portion) 147*k* (147*k*1-147*k*4) retracts into the space 147*l* provided at the outside with respect to the radial direction of the cylindrical member 147 temporarily by the elastic deformation in accordance with the insertion of the driving portion 150*b* (FIG. 7*c*). The driving portion 150*b* is insertable into the accommodating portion 147*j*. Here, the relation of the D15=Z6 is satisfied temporarily. When the insertion into the accommodating portion 147*j* of the driving portion 150*b* completes, the retaining portions 147*k* (147*k*1-147*k*4) having been elastically deformed restores the previous state. Here, the relation of the Z6>D15 is satisfied.

By this, the coupling 150 and the cylindrical member 147 are unified with each other, so that a drive unit U1 is provided (FIG. 7*d*).

As shown in FIG. 7*e*, the side cover 157 is inserted in the direction of the arrow X33. By this, the retaining portion (second regulating portion) 157*a* integrally formed on the side cover 157 enters a space (the gap) 147*l* between the inner surface and itself of the cylindrical member 147. More particularly, in the state that the retaining portion 157*a* is in the space (the gap) 147*l*, the side cover 157 is mounted to by frame 113, while interposing the bearing member 138. As shown in FIG. 7 (*f*), by this, the retaining portion 147*k* (147*k*1-147*k*4) is prevented from the radially outward elastic deformation of the cylindrical member 147. Therefore, this can protect the coupling 150 from disengaging from the cylindrical member 147. According to this embodiment, in mounting the side cover 157 to the frame 113, the retaining portion 157*a* is in the space (the gap) 147*l*. Therefore, the assemblying operativity of the cartridge B is improved. More particularly, the operativity in the mounting of the side cover 157 to the frame 113 can be improved. According to this embodiment, there are following two methods for mounting the side cover 157 to the frame 113. In the first method, after mounting the bearing member 138 to the frame 113, the side cover 157 is mounted to the frame 113 (FIG. 13 (*b*)). In the second method, the bearing member 138 and the side cover 157 are unified with each other, and then they are mounted to the frame 113 (FIG. 20 (*b*)). In any of the methods, according to this embodiment, the assembly operativity of the cartridge B can be improved.

The retaining portion 147*k* may be unintegral with the side cover 157, as a separate coupling retaining member.

In this manner, the coupling 150 is mounted movably pivotably, revolvably between the rotational force transmitting angular position and the pre-engagement angular position, and between the rotational force transmitting angular position and the disengaging angular position, in the cylindrical member 147.

As has been described hereinbefore, the cartridge B of the present embodiment includes the coupling (coupling member) 150 for receiving the rotational force for rotating the developing roller 110 from the main assembly A in the state that the cartridge B is mounted in the main assembly A. It has the cylindrical member 147 which supports the one-end portion (driving portion 150*b*) of the coupling 150 inside movable. The inside of the cylindrical member 147 is provided with the cylinder side force receiving portion (rotational force receiving portion) 147*h* (147*h*1, h2) for receiving the rotational force received from the main assembly A by the coupling 150. The outer peripheral surface of the cylindrical member 147 is provided with the gear (first gear) 147*a* for transmitting the rotational force received by the force receiving portion 147*h* to the developing roller 110.

The cylindrical member 147 is provided with the retaining portion (first regulating portion) 147*k* for preventing the driving portion 150*b* which is the one-end portion of the coupling 150 mounted to the cylindrical member 147 from separating in the axial direction of the cylindrical member 147. The axial direction of the cylindrical member 147 is the direction which is the same as the axis L2 of the coupling 150 which is in the rotational force transmitting angular position. Here, the retaining portion 147*k* is provided deformably in the radial direction of the cylindrical member 147. The retaining portion 147*k* is provided inside of the cylindrical member 147. The inside of the cylindrical member 147 means the inside of the end, with respect to the axial direction, of the cylindrical member 147.

There are provided a retaining portion (second regulating portion) 157*a* for regulating the deformation of the retaining portions 147*k* (147*k*1-147*k*4) in the state that the one-end portion (driving portion 150*b*) of the coupling 150 is mounted to the inside of the cylindrical member 147 while deforming the retaining portion 147*k*. The retaining portion 157*a* is provided inside of the side cover 157. The inside of the side cover 157 means that in the state that the side cover 157 is mounted to the frame 113, it is the inside i.e. frame 113 side. The retaining portion (first regulating portion) 147*k* is made of resin material, is deformable in the radial direction of the cylindrical member 147 because of the elastic force of the resin material.

A plurality of retaining portions (first regulating portions) 147*k* are provided with the intervals in the circumferential direction along the circumferential direction of the cylindrical member 147. The retaining portions 147*k* is deformable in the radial direction. The retaining portions 147*k* are separated from the inner surface of the cylindrical member 147 with the space (gap) 147*l* (147*l*1 or 147*l*2)) (FIG. 7 (*c*), (*e*), and (*f*)). The retaining portion (second regulating portion) 157*a* enters at least one space 147*l* to protect the retaining portion 147*k* from outward deformation of the cylindrical member 147 with respect to the radial direction (FIG. 7 (*f*)). In addition, the cylindrical member 147, the rotational force reception surface (cylinder side force receiving portion) 147*h*, and the retaining portion 147*k* are made of the resin material and are integrally molded. The driving portion 150*b* (one-end portion) of the coupling 150 is spherical.

In order to prevent the coupling 150 from separating from the cylindrical member 147, the retaining portion 147*k* has a projection S. In order to prevent the spherical portion from separating from the cylindrical member 147, the projection S projects inwardly of the cylindrical member 147 with respect to the radial direction. The projection S prevents the spherical portion from disengaging in the axial direction of the cylindrical member 147 (FIG. 7 (*c*) and FIG. 8). In the state that the side cover 157 is connected with the bearing member 138, it covers the cylindrical member 147 which supports the one-end portion of the coupling 159 so as to permit rotation thereof.

The side cover 157 is provided with a retaining portion 157*a* (FIG. 7 (*e*), (*f*)). The retaining portion 157*a* is entered into at least one space 147*l* provided between the inner surface of the cylindrical member 147 and the retaining portion 147*k*. By this, the deformation of the retaining portion 147*k* is regulated (FIG. 7 (*f*)). According to this embodiment, in mounting the driving portion 150*b* to the inside of the cylindrical member 147, the retaining portion 147*k* outwardly deforms in the radial direction. By this, the driving portion 150*b* is permitted to enter the cylindrical member 147. In this manner, the driving portion 150*b* can be smoothly mounted into the cylindrical member 147. In addition, the retaining portion 157*a* enters the space 147*l* only by mounting the side cover 157 to the frame 113. Therefore, the deformation of the retaining portion 147*k* can be regulated. Also in dismounting the driving portion 150*b* reversely from the cylindrical member 147, the retaining portion 147*k* outwardly deforms in the radial direction. By this, the driving portion 150*b* can be smoothly dismounted from the cylindrical member 147.

The coupling mounting method for mounting the coupling 150 to the frame 113 includes a mounting step of the coupling member and a mounting step of the side cover. In the mounting step of the coupling member, while the retaining portion (first regulating portion) 147*k* made of resin material outwardly deforms with respect to the radial direction, the one-end portion of the coupling 150 is mounted movably to the inside of the cylindrical member 147. The mounting step of the side cover for mounting the side cover 157 to the frame 113 has the following steps. The cylindrical member 147 intervenes between the bearing member 138 and the side cover 157. The retaining portion (second regulating portion) 157*a* of the side cover 157, is entered into at least one space (the gap) 147*l*, in the state that the other end portion of the coupling 150 projects through the opening 157*j* of the side cover 157. By this, the side cover 157 is mounted to the frame 113 so that it regulates that the retaining portion (first regulating portion) 147*k* bends The retaining portion 147*k* is disposed at the each of the positions with the intervals along the circumferential direction of the cylindrical member 147, and the deformation is possible in the radial direction. The one-end portion of the coupling 150 of the cylindrical member 147 is mounted to the inside by the mounting step of the coupling member. The bearing member 138 supports the shaft portion 110*a* mounted to said one longitudinal end portion of the frame 113 (shaft portion 110*a* of said one longitudinal end portion of the developing roller 110). The space (the gap) 147*l* is at least one space (the gap) 147*l* between the inner surface of the cylindrical member 147 and the retaining portion 147*k*.

The coupling member dismounting method for dismounting, from the frame 113, the coupling 150 includes a side cover removal step and a coupling member removal step. The side cover dismounting is a step for dismounting the side cover 157 from the frame 113. Here, the side cover 157 is mounted to the frame 113, while making the cylindrical member 147 which supports the coupling 150 intervene between it and the bearing member 138. The side cover 157 is in the state that the other end portion of the coupling 150 projects through the opening 157*j*, and is mounted to the frame 113. The side cover 157 is mounted to the frame 113 so that the deformation of the retaining portion 147*k* is regulated by making the retaining portion 157*a* of the side cover 157 enter at least one space 147*l* between the inner surface of the cylindrical member 147 and the retaining portion 147. The coupling member dismounting step is a step for dismounting the coupling 150 from the cylindrical member 147. the coupling member dismounting step is carried out after the side cover dismounting step is carried out to dismount the side cover 157 from the frame 113. The coupling member dismounting step is carried out, while deforming the retaining portion 147*k* outside in the radial direction of the cylindrical member 147, when the coupling 150 is dismounted from the cylindrical member 147.

The mounting of the side cover 157 to the frame 113 in the side cover 157 mounting step is carried out in the state that the coupling 150 abuts to the inclination regulating portion 157*n* by the elastic force of the spring 159 of the side cover 157. The side cover 157 is mounted to the frame 113 integrally with the coupling 150. The side cover 157 dismounting step of dismounting the side cover 157 is also carried out in the similar state. Since the side cover 157 and the coupling 150 can be mounted to the frame 113 integrally in this step, the operativity can be improved. In addition, the removal operativity can be improved.

According to this embodiment, in mounting the coupling 150, it mounts and the operativity can be improved. According to this embodiment, in dismounting the coupling 150 from the cartridge B, the operativity can be improved. According to this embodiment, in exchanging the coupling 150 mounted to the cartridge B, the exchanging operativity can be improved. According to this embodiment, the exchange method of the coupling 150 with which the exchanging operativity is improved in exchanging the coupling 150 mounted to the cartridge B can be provided.

By this, the coupling 150 can be mounted to the cylindrical member 147 by the simple step of unidirectional motion along the direction of the axis L2. In this manner, the coupling 150 does not disengage from the cylindrical member 147 in the image forming operation in the state that the coupling 150 is mounted to the cartridge B. Accordingly, the production of the image defect can be prevented.

Figure 9:
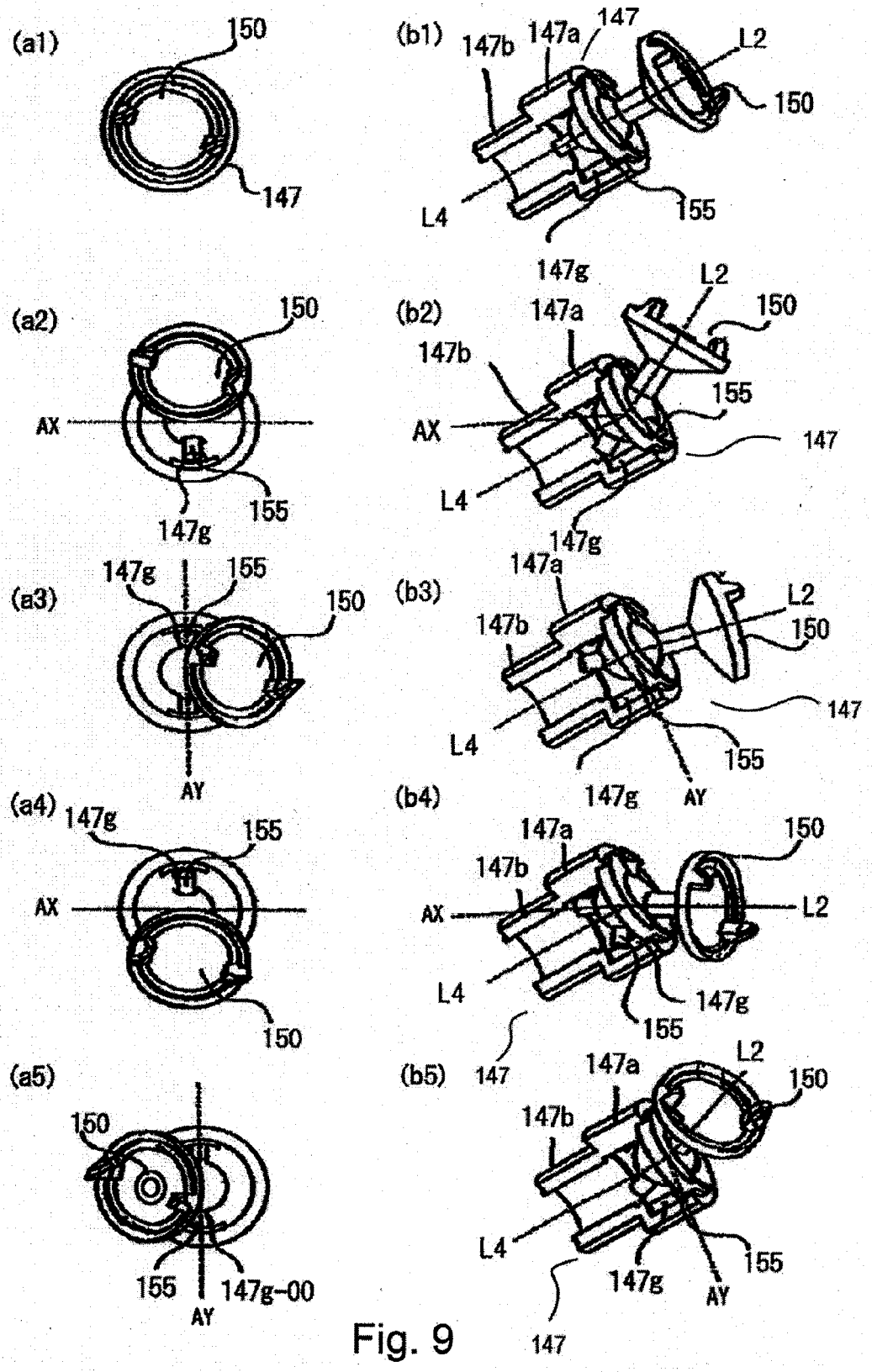
FIG. 9 is a perspective view of a drive unit according to an embodiment of the present invention.

Referring to FIG. 9, the description will be made as to the movement range, relative to the cylindrical member 147, of the coupling 150.

FIG. 9 illustrates a connection state of the cylindrical member 147 and the coupling 150. FIG. 9 (*a*1)-(*a*5) is a view, as seen from the drive shaft 180, and is a perspective view of the structures shown in FIGS. 9 (*b*1)-(*b*5).

as shown in FIG. 9, Here, the coupling 150 is mounted to the cylindrical member 147 so that the axis L2 thereof can incline in all the directions relative to the axis L4

In FIGS. 9 (a1) and (b1), the axis L2 is co-axial with the axis L4. FIGS. 9 (a2) and (b2) illustrate the state that the coupling 150 inclines upward from this state. When the coupling 150 inclines toward the opening 151*g*, the transmission pin 155 is moved along the opening 151*g* (FIG. 9 (a2), (b2)). As a result, the coupling 150 inclines about an axis AX perpendicular of the axis to the opening 151*g*.

The state that the coupling 150 rightwardly inclines in FIGS. 9 (a3) and (b3) is illustrated. Thus, when the coupling inclines toward the opening 151*g*, the pin 155 rotates in the opening 151*g*. The axis L2 at the time of the rotation is the axis line AY of the transmission pin 155.

FIG. 9 (a4), (b4) FIGS. 9 (a5), and (b5) shows the state that the coupling 150 is inclined downward, and the state that it is inclined leftward. The coupling 150 inclines about the rotation axes AX and AY.

Here, in the direction different from the inclining direction described, the inclining motion with which the rotation about the axis AX and the rotation about the axis AY are combined occurs. The examples of the direction different from the inclining direction are shown in FIGS. 9 (a2), (a3), (a3), (a4), (a4), (a5), (a5) and (a2). In this manner, with respect to the axis L4, the axis L2 can incline in all the directions.

The axis L2 has been described as being inclinable in any directions relative to the axis L4. However, the axis L2 is not necessarily inclinable to the predetermined angle relative to the axis L4 in any orientation over 360 degrees. In the case that it is not satisfied, what is necessary is just to form the opening 147*g*, for example, more widely in the circumferential direction. With such setting, when the axis L2 inclines relative to the axis L4, the linear inclination through the predetermined may not be possible, and even in such a case, the coupling 150 revolves to a slight degree about the axis L2. By this, the axis L2 can incline to the predetermined angle relative to the axis L4. In other words, the play of the rotational direction of the opening 147*g* can be selected properly, if necessary.

As has been described hereinbefore (FIG. 7), the spherical surface 150*i* contacts to the retention surface 147*l*. For this reason, the coupling 150 is mounted so that the sphere center P2 of the spherical surface 150*i* is the rotation center. In other words, the axis L2 is pivotably mounted irrespective of a phase of the cylindrical member 147.

Then, a regulating method for inclining the axis L2 toward the downstream side in the rotational direction X4 relative to the axis L4 just before the engagement will be described.

Figure 10:
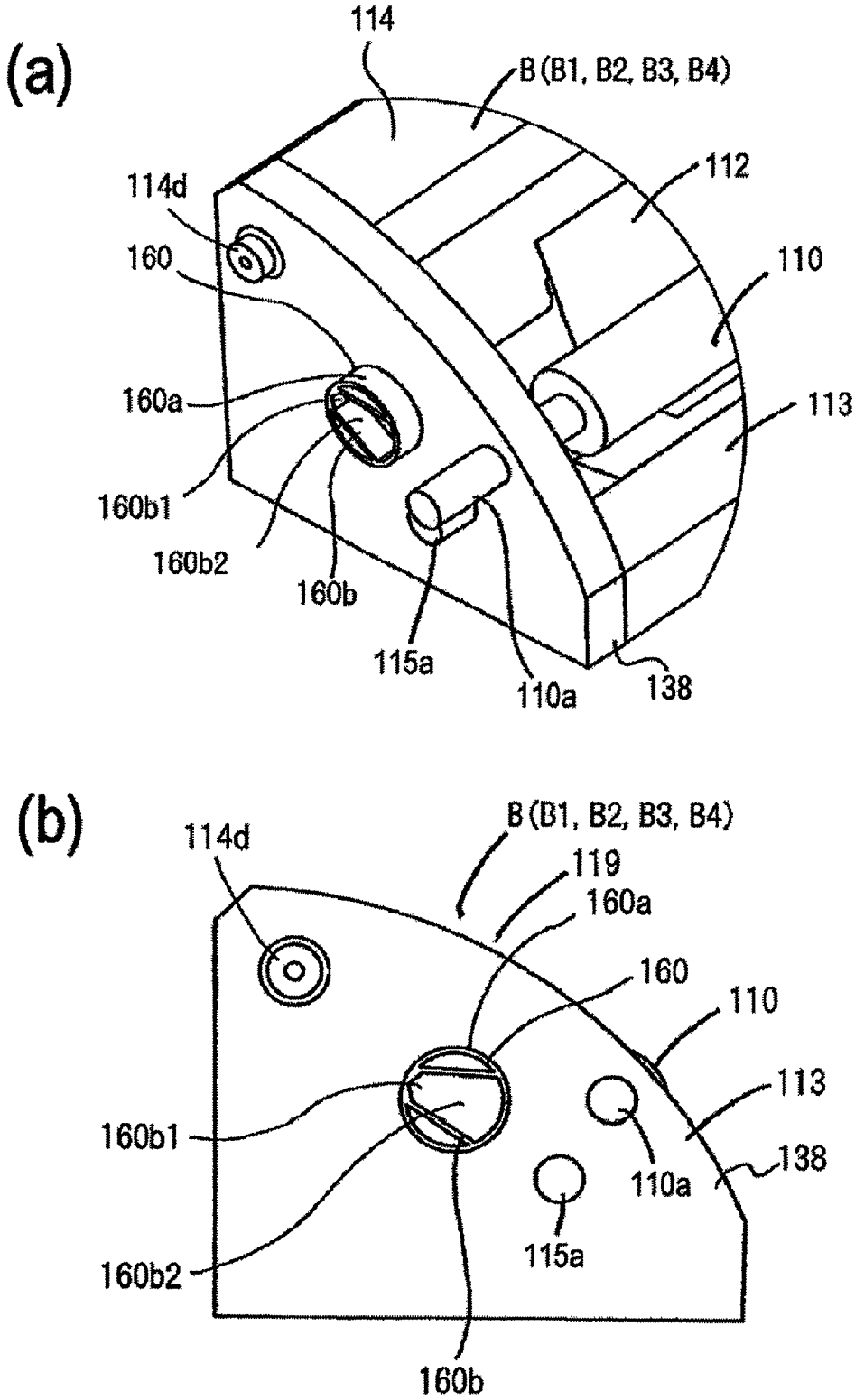
FIG. 10 is a perspective view and a side view, as seen from the main assembly side, of the regulating portion according to an embodiment of the present invention.
Figure 11:
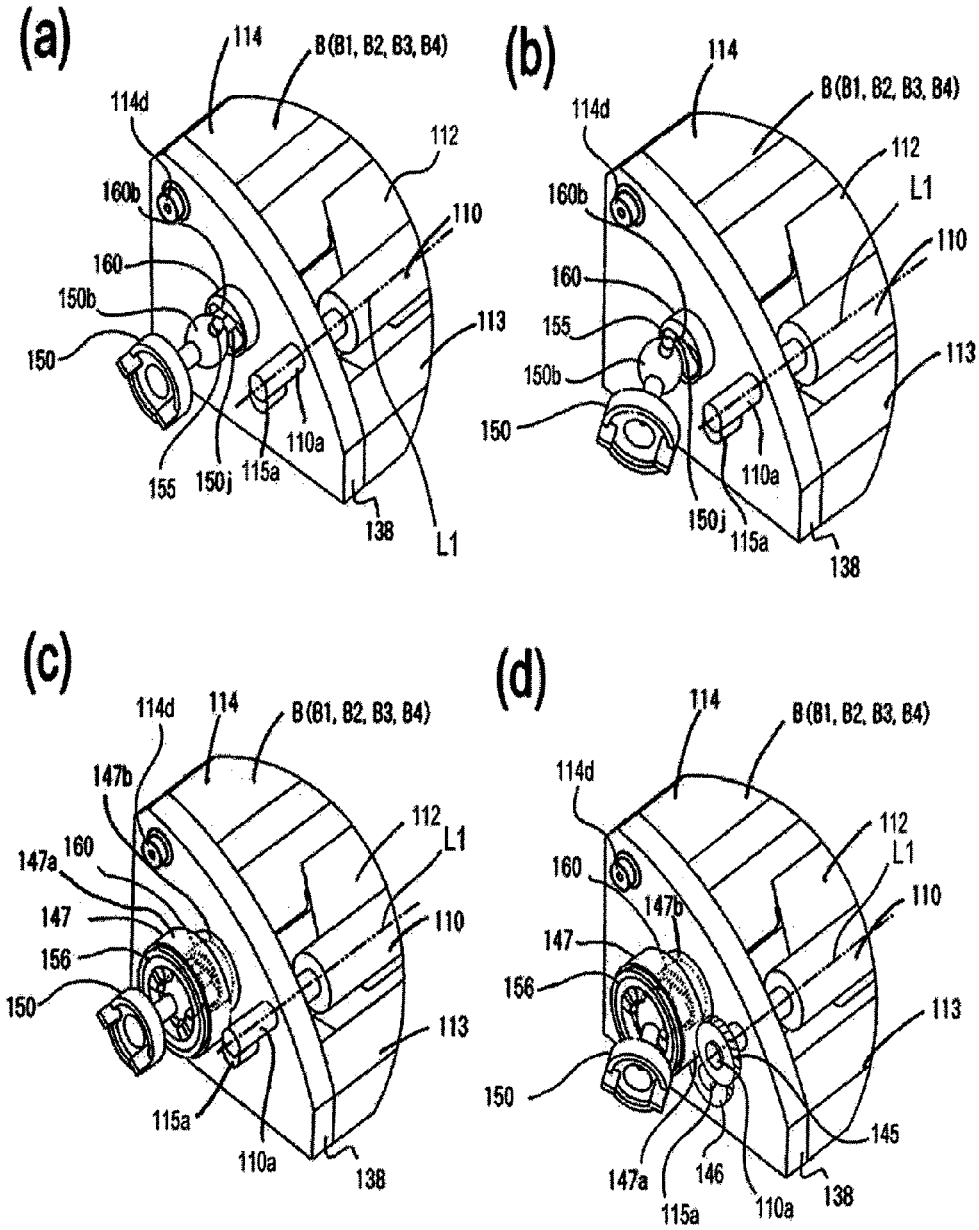
FIG. 11 is a perspective view illustrating a positional relation between a coupling and a regulating portion in the embodiment of the present invention.

An angular position regulating portion ("regulating portion") 160 of the coupling 150 will be described, referring to FIGS. 10 (*a*) and 11. FIG. 10 (*a*) is a perspective view, as seen from the main assembly side, of a regulating portion (inclination regulating portion) 160. FIG. 10 (*b*) is a side view, as seen from the main assembly side, of the regulating portion 160. FIG. 11 (*a*) is a perspective view illustrating the positional relation between the coupling 150 and the regulating portion 160, in the case where the coupling 150 takes the drive transmission angular position (which will be described hereinafter). FIG. 11 (*b*) is a perspective view illustrating the positional relation between the coupling 150 and the regulating portion 160, in the case where the coupling 150 takes the pre-engagement angular position as will be described hereinafter. FIG. 11 (*c*) and FIG. 11 (*d*) show the states of the cylindrical member 147 and the retaining member 156 in the states of FIG. 11 (*a*) and FIG. 11 (*b*), respectively.

The regulating portion 160 has a bearing portion 160*a* and a regulating portion accommodating portion 160*b* (FIG. 10). The regulating portion accommodating portion 160*b* has a positioning portion 160*b*1 and a free portion 160*b*2. The regulating portion 160 is integral with the bearing member 138. The regulating portion 160 is provided outside the bearing member 138. The outside of the bearing member 138 is the outside in the state that the bearing member 138 is mounted to the frame 113, and it is opposite from the frame. The outside of the bearing member 138 is provided with the gears 145, 146 and the coupling 150.

The bearing portion 160*a* rotatably supports the inner surface 147*i* (FIG. 7 (*b*)) of the cylindrical member 147. The accommodating portion 160*b* contains the coupling regulating portion 150*j* of the coupling 150. In this state, the coupling 150 is movable freely in the range in which the regulating portion 150*j* does not interfere with the wall of the accommodating portion 160*b*.

The coupling 150 is urged by the elastic force of the torsion coil spring (coupling side elastic material) 159 as will be described hereinafter to the pre-engagement angular position. At this time, the regulating portion 150*j* abuts to the positioning portion 160*b*1, and the coupling 150 is positioned in the optimal pre-engagement angular position for the start of the engagement with the drive shaft 180. More particularly, the positioning portion 160*b*1 functions as the positioning portion, only when the coupling 150 is at the pre-engagement angular position.

In the case where the coupling 150 is in a position other than the pre-engagement angular position, the coupling 150 is movable freely in the range in which the regulating portion 150*j* does not interfere with the inner wall of the free portion 160*b*2. In the case where the coupling 150 is in the position other than the pre-engagement angular position, the coupling 150 is in a position between the pre-engagement angular position and the rotational force transmitting angular position, at the rotational force transmitting angular position, at the position between the rotational force transmitting angular position and the disengaging angular position, or at the disengaging angular position.

In the case where the coupling 150 moves from the position other than the pre-engagement angular position by an elastic force of the spring 159 to the pre-engagement angular position, the regulating portion 150*j* is guided by a wall of the free portion 160*b*2. And, the regulating portion 150*j* is guided to the positioning portion 160*b*1. The coupling 150 reaches the pre-engagement angular position.

Figure 12:
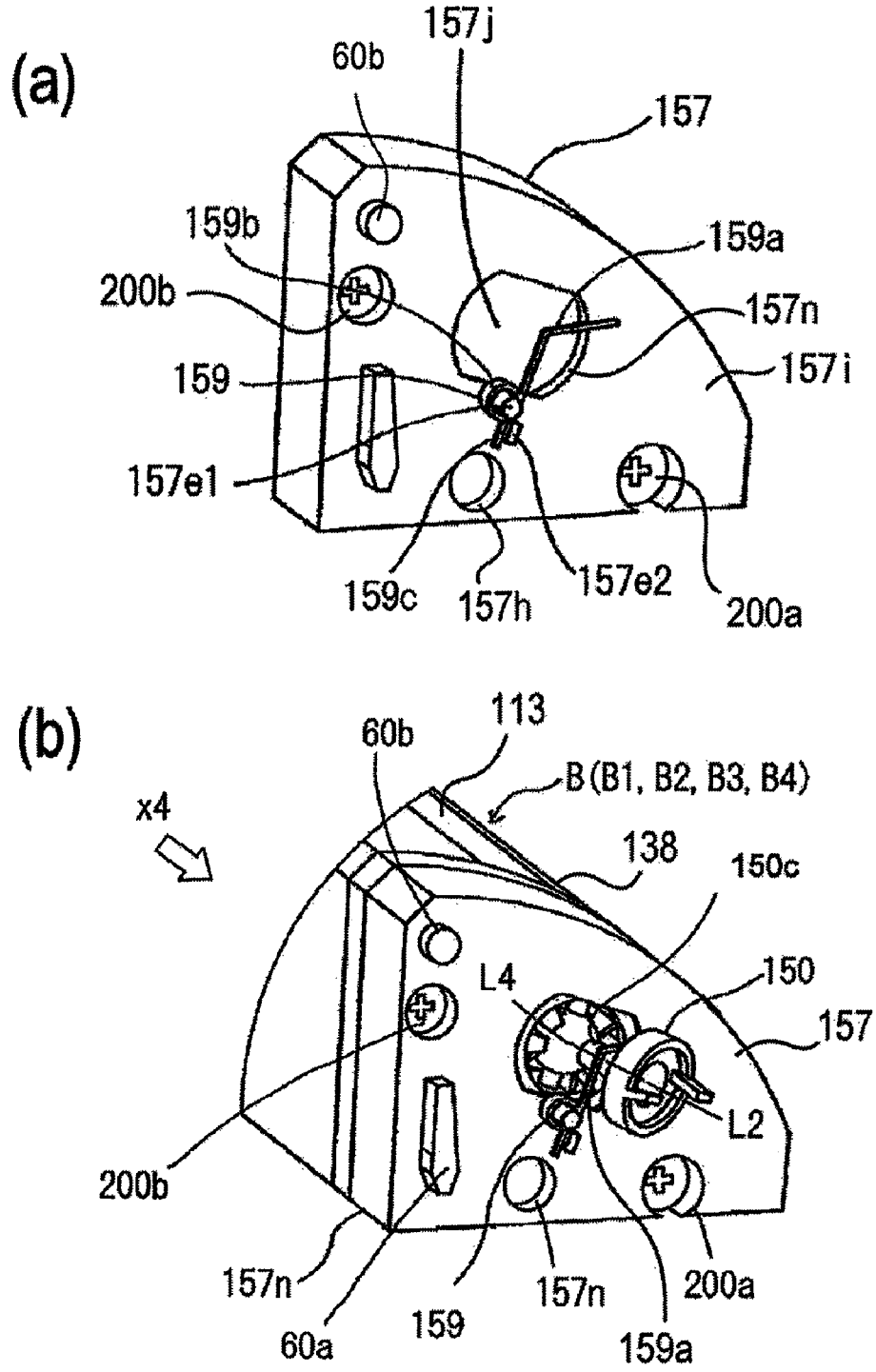
FIG. 12 is a perspective view of an urging member and a side cover according to an embodiment of the present invention (a) and a perspective view (b) of a cartridge drive portion according to an embodiment of the present invention.

Referring to FIG. 12 (*a*) and FIG. 12 (*b*), the spring 159 will be described. The spring 159 provides an urging force for moving the coupling 150 on the pre-engagement angular position. FIG. 12 (*a*) is a perspective view illustrating the state that the spring 159 is mounted to the side cover 157, and FIG. 12 (*b*) is a perspective view of the cartridge B.

As shown in FIG. 12 (*a*), a spring supporting portion 157*e*1 and a spring rotation-stopper 157*e*2 is provided on the lateral surface 157*i* of the side cover 157. A coil part 159*b* of the spring 159 is mounted to the supporting portion 157*e*1. A rotation-stopper arm 159*c* of the spring 159 abuts to a spring rotation-stopper 157*e*2. As shown in FIG. 12 (*b*), a contact portion 159*a* of the spring 159 contacts to an intermediate part 150*c* of the coupling 150. In this state, the spring 159 is twisted to produce an elastic force. The intermediate part 150*c* is urged by this elastic force. By this, the axis L2 of the coupling 150 inclines relative to the axis L4 (FIG. 12 (*b*), the pre-engagement angular position).) The contact position relative to the intermediate part 150*c* of the spring 159 is set in a upstream side of the center of the driving portion 159*b* with respect to the rotational direction X4. For this reason, the axis L2 inclines relative to the axis L4 so that the driven portion 150*a* side faces the downstream side with respect to the rotational direction X4.

In this embodiment, although the torsion coil spring has been used as the elastic material, this is not restrictive. It may be a leaf springs, rubber, sponge and so on, for example, if it can produce the elastic force. However, in order to incline the axis L2, a certain amount of stroke is required. For this reason, a member which can easily provide such a stroke as to the pre-engagement angular position is desirable.

(Mounting to Cartridge Frame 113 of Coupling 150)

Referring to FIG. 13, the mounting method for mounting the coupling 150 to the developing device frame (cartridge frame) 113 will be described. FIG. 13 (*a*) is a perspective view of the cartridge B before mounting the spring 159 to the cylindrical member 147. FIG. 13 (*b*) is a perspective view of the cartridge B before mounting the side cover 157 and the spring 159. FIG. 13 (*c*) is a perspective view of the cartridge B before mounting the spring 159 to the side cover 157. FIG. 13 (*d*) is a perspective view of the cartridge B to which the spring 159 has been mounted.

The bearing member 138, the developing roller 110, and the supply roller 115 are mounted to the frame 113. At this time, the bearing member 138 is fixed to the developing device frame 113 by, the first screw (first fastening member) 200*c*. In addition, the a developing roller gear 145 for transmitting a rotational force from the gear 147*a* provided on the cylindrical member 147 to the developing roller 110 is mounted to the one-end shaft portion 110*a*. In addition, the a supply roller gear 146 for transmitting a rotational force from the gear 147*b* provided on the cylindrical member 147 to the supply roller 110 is mounted to one-end shaft portion 115*a*. The one-end shaft portion 110*a* is provided at said one longitudinal end portion of the developing roller 110, and it is supported rotatably by the bearing member 138. The one-end shaft portion 115*a* is provided at said one longitudinal end portion of the supply roller 115, and it is supported rotatably by the bearing member 138. The other end shaft 110*b* is provided at the other longitudinal end portion of the developing roller 110, and it is supported rotatably by the bearing member 139. The other end shaft 115*b* is provided at the other longitudinal end portion of the supply roller 115, and it is supported rotatably by the bearing member 139. By this, the developing roller 110 and the supply roller 115 are supported by the frame 113 through the bearing members 138, 139.

First, the cylindrical member 147) which has the mounted drive unit (coupling 150) is mounted to the regulating portion 160 (FIG. 13 (*b*)). At this time, the mounting is carried out (FIG. 11 (*b*)) so that the coupling regulating portion 150*j* is settled in the regulation slot 160*b* In this state, the developing roller gear 147*a* is engaged with the gear 145, and the supply roller gear 147*b* is engaged with the supply roller gear 146. By this, the rotational force transmission to the roller 110, 115 from the cylindrical member 147 is enabled. The coupling 150 can move freely in the range in which the coupling regulating portion 150*j* does not interfere with the wall of the regulating portion accommodating portion 160*b* in the regulating portion 160.

Then, in the state of interposing the cylindrical member 147 between the bearing member 138 and the side cover 157, the side cover 157 is mounted to the frame 113 (FIG. 13 (*c*)). The coupling 150 passes through the opening 157*j* of the side cover 157 in this mounting operation, so that the bearing 138 and the side cover 157 contact to each other. A screw 200*b* is penetrated through a through-hole 157*f* of the side cover 157 and a through-hole 138*f* of the bearing member 138, and is secured to a screw receptor portion 113*d* provided on the developing device frame 113 (FIG. 27 (*a*)). By this, the side cover 157 and the bearing member 138 are fastened together relative to the developing device frame 113 by the screw 200*b*. In addition, a screw 200*a* penetrates the through-hole 157*g* of the side cover 157, and is secured to the screw receptor portion 113*g* of the developing device frame 113 (FIG. 27 (*a*)). By this, the side cover 157 is fixed to the frame 113 by the screw 200*a*. In addition, a screw 200*c* penetrates the through-hole 138*g* of the bearing member 138, and is mounted to the screw receptor portion 113*g* of the frame 113 (FIG. 27 (*a*)). By this, the bearing member 138 is fixed to the frame 113 by the screw 200*c*. And, the cylindrical member 147 is supported rotatably by the gear supporting portion 160*a*. In addition, the coupling 150 is prevented from separating from the cylindrical member 147 by the retaining portion 157*a*.

Finally, the spring 159 is mounted to the spring supporting portion 157*e*1 of the side cover 157 (FIG. 13 (*d*)). This mounting is carried out so that the intermediate part 150*c* of the coupling 150 abuts to a downstream side of the contact portion 159*a* with respect to the urging direction of the spring 159. In this state, the coupling 150 is urged by the elastic force of the spring 159 to incline toward the downstream side with respect to the rotational direction X4 of the rotary member C. In addition, the regulating portion 150*j* abuts to a V-shaped groove portion 160*b*1 of the regulation slot 160*b*. More particularly, the coupling 150 is fixed substantially to the pre-engagement angular position.

Here, the side cover 157 is provided with the spring 159 and the inclination regulating portion 157*n* (FIG. 8) which regulates the inclination of the coupling 150 which inclines by the elastic force of the spring 159. And, the side cover 157 is mounted to the frame 113 by the screw (second screw) 200*a* and the screw (third screw) 200*b*. In this case, the coupling 150 can be mounted to the frame 113 integrally with the side cover 157 (FIG. 20 (*b*)). This is because, the coupling 150 is pressed on the regulating portion 157*n* by the elastic force of the spring 159, and the coupling 150 is supported by the side cover 157. Therefore, the operativity in the mounting of the coupling 150 to the frame 113 is improved. In addition, according to this embodiment, the coupling 150, the side cover 157, and the bearing member 138 can be integrally mounted to the frame 113 (FIG. 20 (*b*)). Therefore, the mounting operativity at the time of mounting the coupling 150, the side cover 157 and the bearing member 138 to the frame 113 can be improved. However, the present invention is not limited to this structure, but these may individually be mounted to the frame 113.

In addition, as to the mounting method after mounting the cylindrical member 147 to the side cover 157, the side cover 157 may be mounted to the frame 113, and one skilled in the art can properly select the order of the mounting.

(Mounting and Demounting Method of Cartridge B Relative to Main Assembly)

Figure 14:
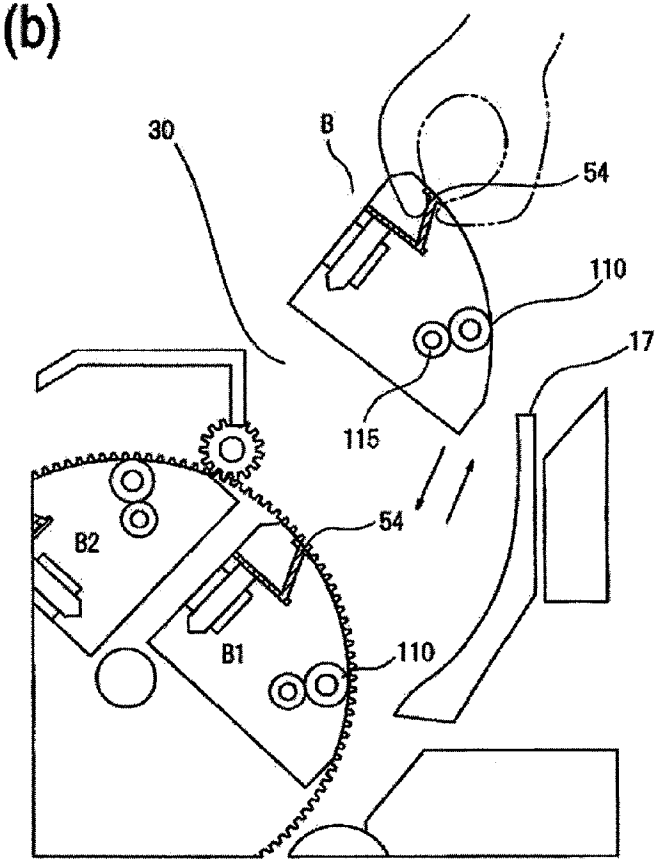
FIG. 14 is a longitudinal sectional view (a) of the electrophotographic image forming apparatus main assembly in the development stand-by position according to an embodiment of the present invention, and a longitudinal sectional view (b) of the electrophotographic image forming apparatus main assembly at the time of the cartridge mounting.
Figure 14:
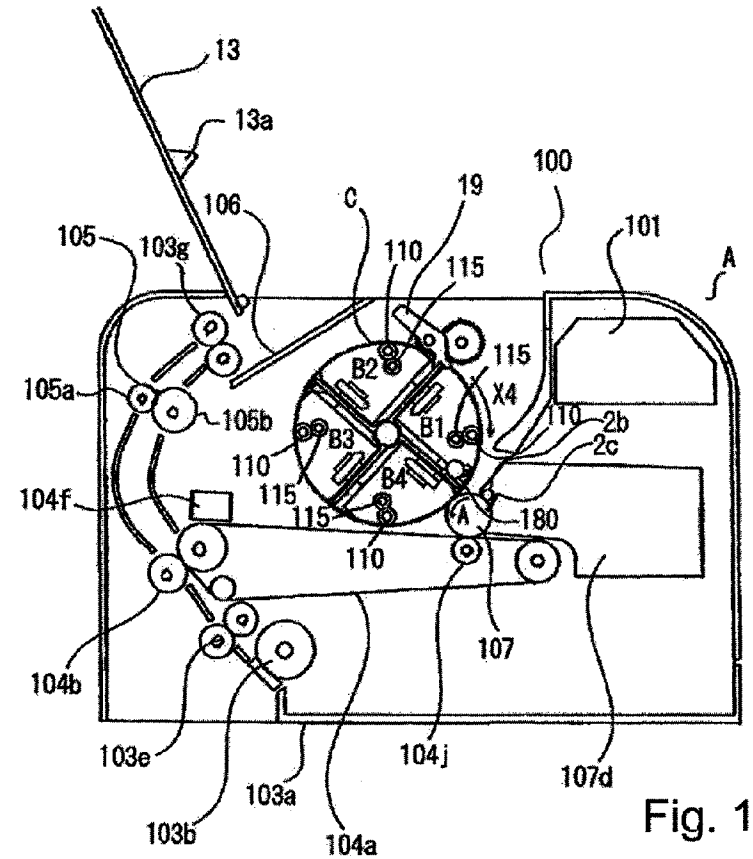
Figure 15:
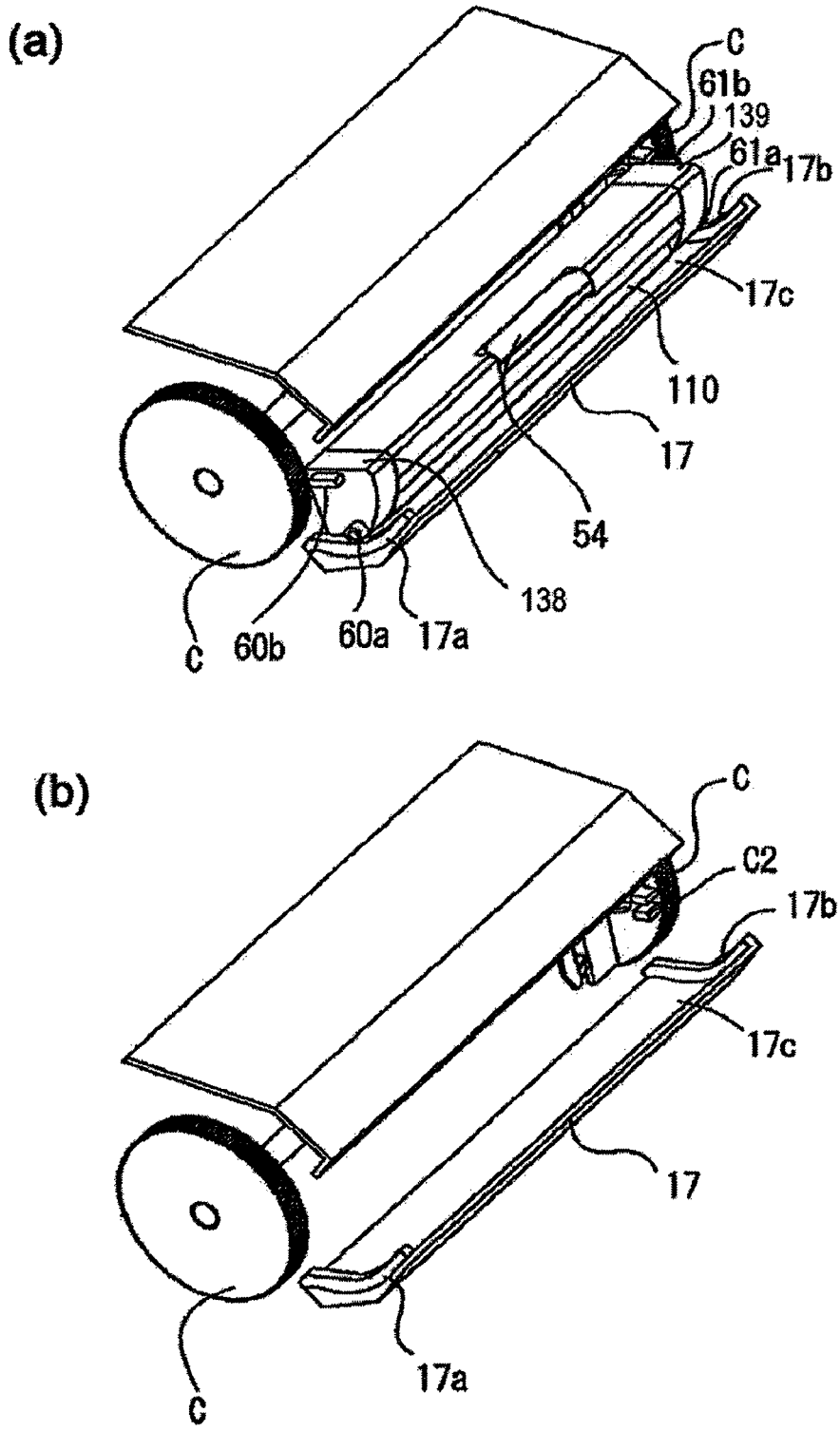
FIG. 15 is a perspective view of the cartridge at the time of the mounting according to the embodiment of the present invention.

Referring to FIG. 14-FIG. 15, the mounting and dismounting operation of the cartridge B relative to the main assembly A of color electrophotographic image forming apparatus will be described.

FIG. 14 (*a*) is a sectional view illustrating a position for a position to which the rotary member C is shifted by a predetermined angle phase from the developing position i.e. the cartridge mounting and demounting and for the stand-by. The rotary member C takes this stand-by position except during the developing operation, and the mounting and dismounting operation of the cartridge B (B1-B4) is also carried out in this position. In this embodiment, the position of 45 degrees upstream of the developing position is the stand-by position.

When the cartridge B (B1-B4) is to be mounted and demounted, the user first opens the mounting and demounting cover 13. By this, the user can access to the cartridge B (B1-B4). The cartridge B1 of the four cartridge s B is in the mounting and dismounting position in FIG. 14 (*a*), and the cover 13 is open. The cover 13 operates interrelatedly with an interlock SW (unshown), and interrelating SW is rendered OFF by the releasing thereof. By this, the drive of the main assembly A is stored. Simultaneously, the elastic force of the spring (unshown) rotates the cartridge engagement releasing member 19 urged in the direction of the arrow in the Figure by the releasing of the cover 13. And, the releasing member 19 presses a cartridge locking member (unshown). This moves the locking member (unshown) to the guide portion 60*b* which is the portion-to-be-locked of the cartridge B, and a position which is not engaged. By this, only the cartridge B1 which is in the mounting and dismounting position is released from the rotary member C. Then, the user can mount and demount the cartridge B1.

When the user closes the cover 13, as shown in FIG. 1, a projection 13*a* provided on the cover 13 rotates the releasing member 119 counterclockwisely. By this, the releasing member 119 is held in a position where it is not contacted to the developing device locking member (unshown). Accordingly, when interlocking SW is ON, all the cartridges B (B1-B4) are certainly in the locked position. For this reason, the trouble that the main assembly A is operated without locking the cartridge B (B1-B4) is avoided assuredly.

The operation for mounting the cartridge to the image forming apparatus will be described.

As shown in FIG. 14 (*b*), when the user grips the handle 54, the orientation of the cartridge B is determined in general by the gravity center of the cartridge. This orientation is similar to an orientation taken when the cartridge B passes by the opening 30 of the upper portion of the main assembly A.

A mounting orbit of the cartridge B is determined along the main assembly guide 17, and, finally the cartridge B is mounted to the rotary member C. As shown in FIG. 15 (*a*), at this time, the guide portions 60*a*, 61*a* of the side covers 138, 139 fixed to the opposite ends of the cartridge B are guided on the regulation ribs 17*a*, 17*b* of the main assembly guide 17. As shown in FIG. 15 (*a*), when the cartridge B moves from the guide 17 to the inside of the rotary member C, the free ends of the guide portions 60*b*, 61*b* provided at the opposite ends of the cartridge B engage with the guide groove C2 (FIG. 15 (*b*)) of the rotary C. In this state, by the user applying the force in the mounting direction the cartridge B is moved to the inside of the rotary member C, and it can move to the positioning portion (accommodating portion 130A) of the developing roller which is a regular position. The positioning portions in the present embodiment are the outer peripheries of the guide portions 60*a*, 61*a* provided at both sides.

In dismounting the cartridge B from the main assembly A, the operation is carried out in order opposite to that in the mounting operation described above.

Figure 16:
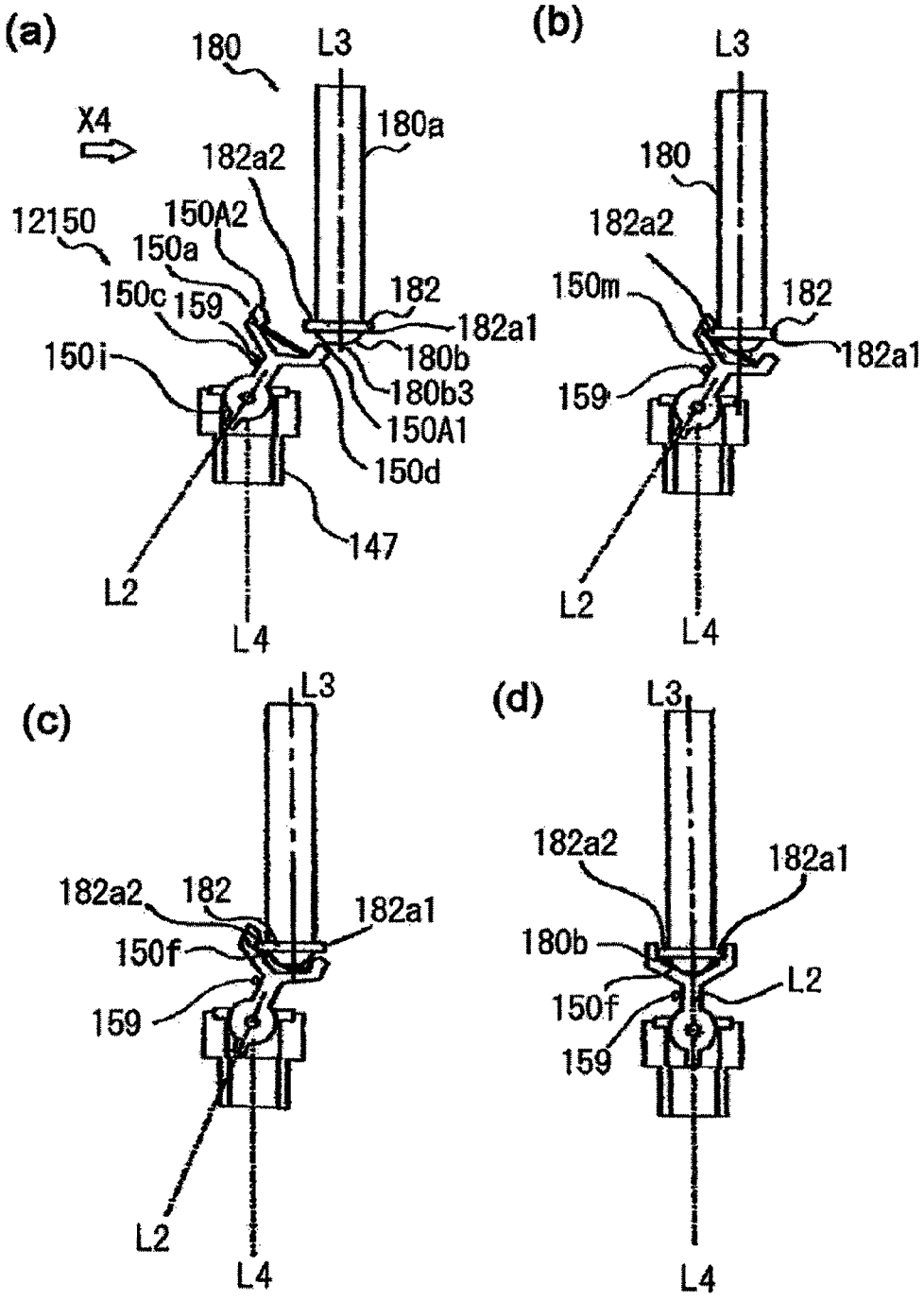
FIG. 16 is a longitudinal sectional view illustrating an engaged state between the drive shaft and the coupling according to an embodiment of the present invention.
Figure 17:
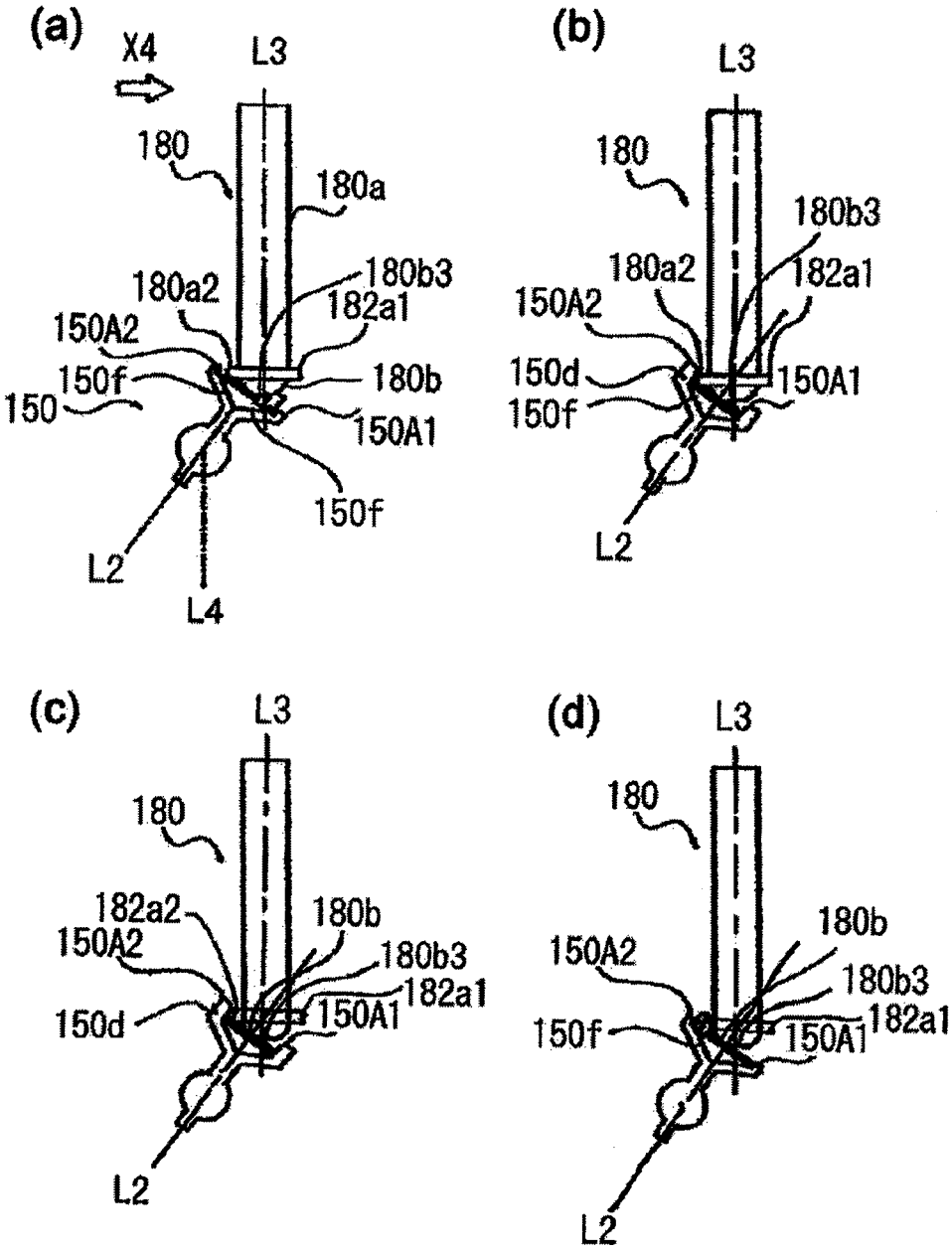
FIG. 17 is a longitudinal sectional view illustrating an engaged state between the drive shaft and the coupling according to an embodiment of the present invention.
Figure 18:
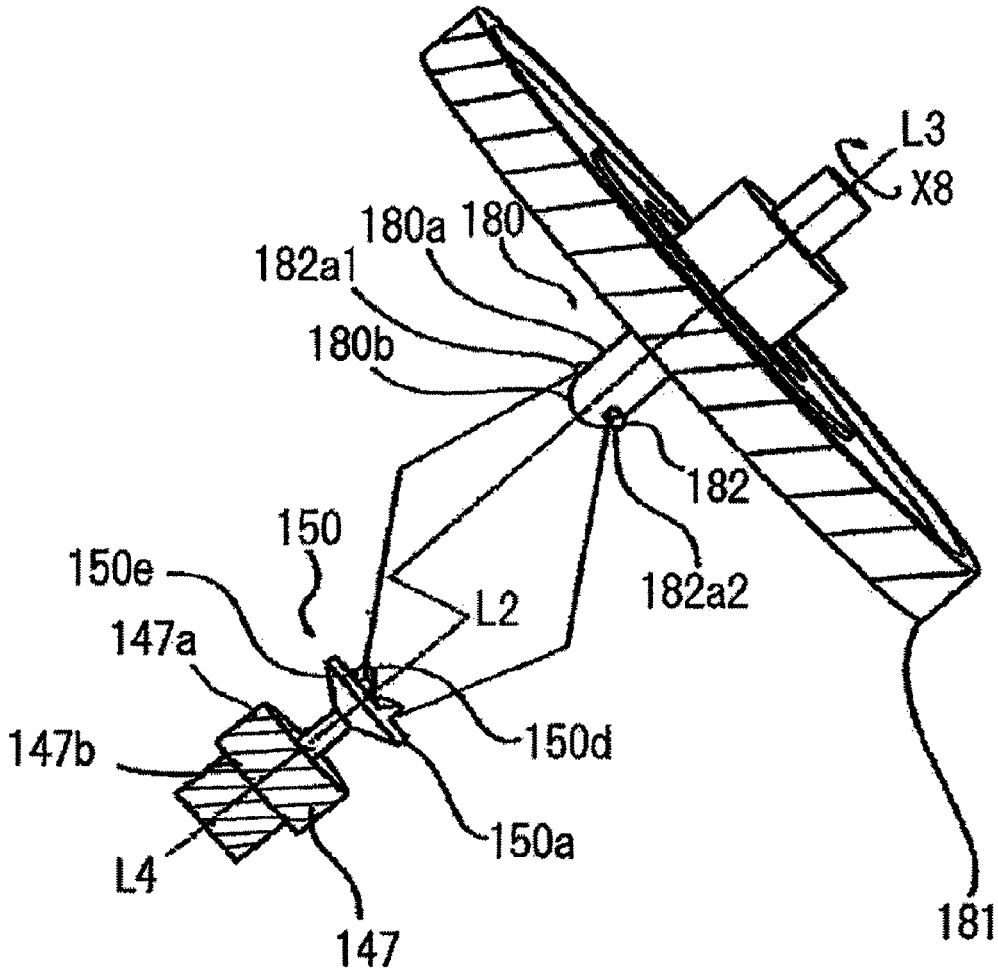
FIG. 18 is a perspective view of the drive shaft and the coupling according to an embodiment of the present invention.

Referring to FIG. 16-FIG. 20, the description will be made as to the engaging operation, the rotational force transmitting operation and the disengaging operation of the coupling. FIG. 16 is longitudinal sectional views of the drive shaft 180, the coupling 150, and the cylindrical member 147. FIG. 17 is longitudinal sectional views illustrating phase differences among the drive shaft 180, the coupling 150 and the cylindrical member 147. FIG. 18 is perspective views of the drive shaft 180, the coupling 150, and the cylindrical member 147. FIG. 19 is a longitudinal sectional view illustrating the drive shaft 180, the coupling 150, and the cylindrical member 147. FIG. 22 is a side sectional view of the drive unit (a) and a perspective view ((b) and (c)) illustrating a disassembling process of the drive unit.

In the process of the movement of the cartridge B to the developing position, the coupling 150 is in the pre-engagement angular position by the rotation of the rotary member C. More particularly, the axis L2 of the coupling 150 inclines by the elastic force of the spring 159 (the urging force), so that the driven portion 150*a* is in the downstream of the axis L4 of the cylindrical member 147 with respect to the rotational direction X4 of the rotary C. In this embodiment, the axis L2 is positioned between the developing roller 110 and the supply roller 115. And, the axis L2 is inclined outwardly with respect to the radial direction of the rotary member C toward downstream of the rotational direction [X4, FIG. 4] of the rotary member C relative to the tangential line of a circle which is concentric with the rotary member C and which passes through the center of the driving portion 150*b*.

The downstream free end position 150A1 is nearer, than the free end 180*b*3 of the drive shaft 180, to the cylindrical member 147 in the direction of the axis L4 with respect to the rotational direction X4 of the rotary C by the inclination of the coupling 150. In addition, the upstream free end position 150A2 with respect to the direction X4 is nearer, than the free end 180*b*3, to the pin 182 in the direction of the axis L4 (FIG. 16 (*a*), (b)). Here, the free end position is the nearest to the drive shaft and the remotest from the axis L2 with respect to the direction of the axis L2 among portions of the driven portion 150*a* of the coupling 150 shown in FIG. 6 (*a*)(*c*). In other words, it is either one edge line of the driven portion 150*a* or one edge line of the non-driving projection 150*d* depending on the rotational phase of the coupling 150 (FIG. 6 (*a*), (c), 150A).

First, the downstream free end position 150A1 with respect to the rotational direction X4 of the rotary member C passes by the free end 180*b*3. After passing by the free end 180*b*3, the receiving surface 150*f* or the projection 150*d* of the coupling 150 contacts to the free end 180*b*3 or the pin 182.

Therefore, it inclines toward the rotation of the rotary member C (FIG. 16 (*c*)) so that the axis L2 is parallel to the axis L4 Here, the rotary member C is temporarily stored in the state shown in FIG. 16 (*c*). At this time, the coupling 150 is in a position between the pre-engagement angular position and the drive transmission angular position. And, the rotational force can be transmitted if the two projections of the coupling 150 and pins 182 contact in this angular position. When the rotary C is at rest, the drive shaft 180 begins to rotate. The pin 182 positioned at the entrance portion 150*k* enters a gap relative to the projection 150*d*. The transmission of the rotational force to the coupling 150 from the drive shaft 180 is started during this temporary rest depending on the rotation phase difference between the coupling 150 and the drive shaft 180. And, the transmission of the rotational force to the coupling 150 from the drive shaft 180 is started by the time reaching the position (FIG. 16 (*d*)) which the rotary C described below, at the latest.

And, finally, the position of the cartridge B is determined relative to the main assembly A. More particularly, the rotary member C stops. In this case, the axis L3 of the drive shaft 180 and the axis of the cylindrical member 147 are substantially co-axial. In other words, it moves inclines, swings, revolves to the rotational force transmitting angular position from the pre-engagement angular position, so that the free end position 150A1 of the coupling 150 is permitted to circumvent the drive shaft 180. The coupling 150 inclines, swings, revolves toward the rotational force transmitting angular position from the pre-engagement angular position, so that the axis L2 is co-axial with the axis L4. Here, the coupling 150 and the drive shaft 180 are engaged with each other (FIG. 16 (*d*)). By this, the recess 150*z* covers the free end portion 180*b*. Therefore, the rotational force is stably transmitted from the drive shaft 180 to the coupling 150. At this time, the pin 155 is in the opening 147*g*, and the pin 182 is in the entrance portion 150*k*.

In addition, in this embodiment, the drive shaft 180 already rotates in the state that the engagement of the coupling 150 with the drive shaft 180 has started. For this reason, the coupling 150 begins the rotation immediately.

As has been described hereinbefore, according to this embodiment, the coupling 150 is inclinable relative to the axis L4. Therefore, the coupling 150 can be smoothly engaged or coupled with the drive shaft 180 by the inclination of the coupling 150 corresponding to the rotation of the rotary member C.

In addition, in this embodiment, as has been described hereinbefore, the drive shaft 180 always rotates. In other words, at the time of the engaging operation, the phase of the drive shaft 180 always changes and the phase relation between the drive shaft 180 and the coupling 150 takes various relations. The engaging operation of the coupling 150 described above is possible irrespective of the phase relation between the drive shaft 180 and the coupling 150. Referring to FIG. 17, this will be described. FIG. 17 illustrates the phases of the coupling and the drive shaft. In FIG. 17, (a) illustrates the state that the pins 182 and the receiving surfaces 150*f* oppose to each other in the upstream side with respect to the rotational direction X4 of the rotary C. In FIG. 17, (b) illustrates the state that the pin 182 and the projection 150*d* oppose to each other. In FIG. 17, (c) illustrates the state that the free end portion 180*b* and the projection 150*d* oppose to each other. In FIG. 17, (d) illustrates the state that the free end portion 180*b* and the receiving surface 150*f* oppose to each other.

As shown in FIG. 9, the coupling 150 is mounted to the cylindrical member 147 so that they are pivotable (revolvable and movable) in all the directions relative to the cylindrical memberFor this reason, as shown in FIG. 17, the coupling 150 is inclinable in the mounting direction X4 irrespective of the phase of the cylindrical member 147. Irrespective of the phase relation between the drive shaft 180 and the coupling 150, the downstream free end position 150A1 with respect to the rotational direction of the rotary member C is downstream of the free end 180*b*3 of the drive shaft 180 with respect to the rotational direction X4 of the rotary member C. The upstream free end position 150A2 with respect to the rotational direction X4 is set by the inclination angle of the coupling 150, so that it is nearer, than the free end 180*b*3, to the pin 182.

With such a setting, the downstream free end position 150A1 with respect to the rotational direction X4 is passed by the free end 180*b*3 in accordance with the rotating operation of the rotary member C. In the case of FIG. 17 (*a*), the receiving surface 150*f* contacts to the pin 182. In the case of FIG. 17 (*b*), the projection 150*d* contacts to the pin 182. In the case of FIG. 17 (*c*), the projection 150*d* contacts to the free end portion 180*b*. In the case of FIG. 17 (*d*), the receiving surface 150*f* contacts to the free end portion 180*b*. In addition, the axis L2 becomes parallel to the axis L4 by the contact force (urging force) produced when the rotary member C rotates, so that they engage or couple with each other. Therefore, irrespective of the phase relation between the drive shaft 180 and the coupling 150 and the phase relation between the coupling 150 and the cylindrical member 147, they can be engaged with each other.

Referring to FIG. 18, a rotational force transmitting operation at the time of rotating the developing roller 110 will be described. The drive shaft 180 rotates with a gear (helical gear) 181 in the rotational direction of an arrow X8 in the Figure by the rotational force received from the motor (unshown). The pins 182 integral with the drive shaft 180 contact to the receiving surfaces 150*e*1, 150*e*2 to rotate the coupling 150. The rotational force by rotating the coupling 150 is transmitted to the development gear 145 mounted to the shaft portion 110*b* of the developing roller 110 through the cylindrical member 147 to rotate the developing roller 110.

In addition, even if the axis L3 and the axis L4 are deviated a little from the coaxial line, the coupling 150 will incline to a corresponding degree, so that it can be rotated by the coupling, without applying the large load to the developing roller 110 and the drive shaft 180.

Referring to FIG. 19, the description will be made as to an operation when the coupling 150 disengages from the drive shaft 180 in response to the movement from the predetermined position (developing position) of the cartridge B by the rotation of the rotary member C in one direction.

First, the position of each pin 182 at the time of the cartridge B moving from the predetermined position will be described. When the image formation finishes, as will be apparent from the foregoing description, the pins 182 are in the entrance portions 150*k*1, 150*k*2. And, the pins 155 are in the openings 150*g* 1 or 150*g*2.

When the image forming operation with which the cartridge B is used finishes, it advances to an image forming operation for which the next cartridge B is used, and the coupling 150 is released from the drive shaft 180 in interrelation with this shifting operation. This operation will be described Immediately after the image forming operation finishes, the coupling 150 takes the rotational force transmitting angular position, wherein the axis L2 and the axis L4 are substantially co-axial (FIG. 19 (*a*)). The cylindrical member 147 moves in the rotational direction X4 with the cartridge B. And, the upstream receiving surface 150*f* with respect to the rotational direction X4 or the projection 150*d* contacts to the free end portion 180*b* of the drive shaft 180 or the pin 182. And, the axis L2 starts the inclination toward the upstream side of the rotational direction X4 (FIG. 19 (*b*)). The direction of this inclination is the direction which is across the cylindrical member 147 from the direction of the inclination of the coupling 150 at the time of the coupling 150 engaging with the drive shaft 180. By the rotating operation of this rotary member C, while contacting to the free end portion 180*b*, the upstream free end portion 150A2 moves in the rotational direction X4. Until the upstream free end portion 150A2 of the axis L2 reaches the free end 180*b*3, the coupling 150 inclines (disengaging angular position, FIG. 19 (*c*)). In this state, the coupling 150 is passed by the free end 180*b*3, while contacting with the free end 180*b*3 of the shaft (FIG. 19 (*d*)). More particularly, the coupling 150 is moved from the rotational force transmitting angular position to the disengaging angular position so that the a part of coupling 150 (the upstream free end position 150A2) which is in the upstream side of the drive shaft 180 with respect to the rotational direction X4 is permitted to circumvent the drive shaft 180. In this manner, the cartridge B moves in accordance with the rotation of the rotary member C.

Before one full-rotation of the rotary member C, the axis L2 of the coupling 150 inclines toward downstream with respect to the rotational direction X4 by the urging force of the spring 159 described in the foregoing. In other words, the coupling 150 is moved from the disengaging angular position to the pre-engagement angular position. By doing so, the state that the coupling 150 is engaeable with the drive shaft 180 is again established after the one rotation of the rotary member C.

At the time of positioning the cartridge B at the predetermined position (position opposed to the photosensitive drum 107), the rotational force transmitting angular position of the coupling 150 is an angular position of the coupling 150 relative to the axis L4 in which the coupling 150 can receive the rotational force from the drive shaft 180, and it can be rotated. The pre-engagement angular position of the coupling 150 is an angular position of the coupling 150 relative to the axis L4 immediately before the coupling 150 engages with the drive shaft 180 in the process in which the cartridge B moves to the predetermined position in accordance with the rotation of the rotary C. The disengaging angular position of the coupling 150 is the angular position of the coupling 150 relative to the axis L4 in the case that the coupling 150 disengages from the drive shaft 180 in the process in which the cartridge B moves from the predetermined position in accordance with the rotation of the rotary C. The axis L4 is the rotation axis of the cylindrical member 147, and in addition, is the rotation axis of the gears 147*a*, 147*b*. The axis L4 is substantially parallel to the axis L1.

The coupling is a member which has the function of transmitting a rotational force (driving force) from a shaft to another shaft, and it is also called a shaft coupling. The structure of the coupling member used in present embodiment is not limited to the structure of the coupling 150, but other proper structures apply.

Figure 20:
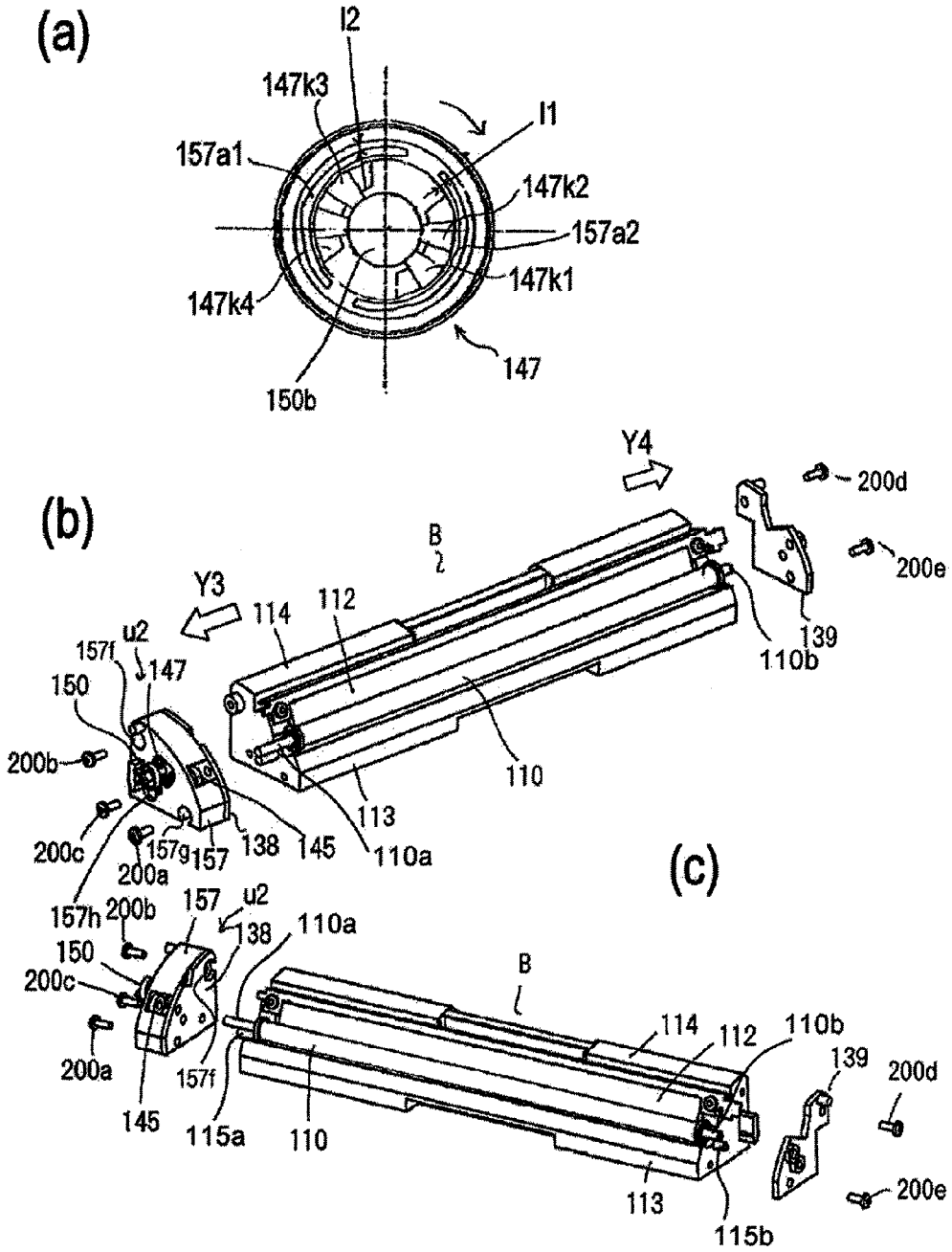
FIG. 20 is a side sectional view (a) of a drive unit according to an embodiment of the present invention and a perspective view (b, c) illustrating a disassembling process of the drive unit.

As shown in FIG. 20 (*a*), the retaining portion 157*a* of the side cover 157 provided in order to prevent the deformation of the retaining portion 147*k* provided in the cylindrical member 147 may not be provided over the entire area on the same circumference. For example, a part may be omitted. The retaining portion 147*k* is rotatable relative to the retaining portion 157*a*. Therefore, it is satisfactory if the retaining portion 157*a* is disposed at the phase that the deformation of at least one pair of retaining portions (147*k*1 and 147*k*3, for example) which face to each other can be prevented, irrespective of the phase of the retaining portion 147*k*.

Dismounting method of developing roller 110 Referring to FIG. 20, the dismounting method of the developing roller 110 in the present embodiment will be described. This Figure is a perspective view illustrating the disassembling process of the cartridge.

As shown in the foregoing description, in said one longitudinal end portion of the cartridge B, the screw 200*b* fastens together the side cover 157 and the bearing member 138 to the frame 113. The screw 200*a* secures the side cover 157 to the frame 113. The screw 200*c* secures the bearing member 138 to the frame 113. Here, as shown in FIG. 3 (*a*) and FIG. 27, the side cover 157 is provided with the through-hole 157*h* coaxial with the screw 200*c*. The outer diameter Z30 of the hole 157*h* is larger than the outer diameter of the screw 200*c*. Therefore, the screw 200*c* can be removed, without dismounting the side cover 157. The screw 200*c* can be removed by inserting a screw driver (tool) through the hole 157*h*. By this, the screws 200*a*, 200*b*, 200*c* can be simultaneously a series of operations removed from the cartridge B in one direction. By doing so, the integral part U2 (FIG. 20 (*b*)) (the side cover 157, the bearing member 138, the drive unit U1, the gear 145, and the gear 146) can simultaneously be dismounted in the direction of the arrow Y3.

In addition, in the other longitudinal end portion of the cartridge B, the bearing member 139 can be dismounted in the direction of the arrow Y4 from the frame 113 by dismounting the screws 200*f*, 200*e*.

A disassembling method of the cartridge B is as follows. The side covers 157 and the bearing members 138, 139 are dismounted from the frame 113, through the following steps s.

In order to dismount the side cover 157 from the frame 113, the screw (second screw) 200*a* is removed. In order to dismount the bearing member 138 from the frame 113, the screw (first screw) 200*c* is removed through the hole 157*h* provided in the side cover 157 from the outside of the side cover 157 with respect to the longitudinal direction of the frame 113. In order to dismount the side cover 157 and the bearing member 138 from the 113 frames, the screw (third screw) 200*b* is removed. In order to dismount the bearing member 139 from the frame 113, the screw (fourth screw) 200*d* is removed. In order to dismount the bearing member 139 from the frame 113, the screw (fifth screw) 200*f* is removed.

By this, the bearing member 138, the bearing member 139, and the side cover 157 can be dismounted from the frame 113. According to this method, the bearing member 138 and the side cover 157 can be efficiently dismounted from the frame 113. This is because the screws 200*a, b, c* can be dismounted through a series of operations. The order of the removal steps is not limited to the order described above. However, the order described above is preferable, because the bearing member 138 and the side cover 157 can be efficiently dismounted from the frame 113. This is because the screw 200*b* which fastens together the side cover 157 and the bearing member 138 to the frame 113 is dismounted finally. By this, the side cover 157 and the bearing member 138 can simultaneously be dismounted from the frame 113.

The developing roller 110 and the supply roller 115 can be dismounted from the frame through the steps described above. According to this method, the developing roller 110 (supply roller 115) can be dismounted quickly from the frame 113. In other words, the operativity in the dismounting of the developing roller 110 (supply roller 115) from the frame 113 can be improved. In the case of manufacturing a new cartridge B, the developing roller 110 (supply roller 115) can be mounted quickly to the frame 113 in the order opposite to that of the order described above. The operativity in the mounting of the developing roller 110 (supply roller 115) to the frame 113 can be improved. In the case of re-using the developing roller 110 (supply roller 115), the similar effects can be provided. However, also, the present embodiment is not limited to the case of re-using the developing roller 110 (supply roller 115), but in the case of manufacturing a new cartridge B, the advantageous effects described above are provided.

In this embodiment, the members for the securing of the bearing member 138 and the side cover 157 to the frame 113 have been described as being screws. However, this is not restrictive. A rivet and so on is usable instead of the screw as a fastening member, for example.

In the case of re-using the developing roller 110, the developing roller 110 dismounted by these steps is subjected to the steps such as the inspection and the cleaning. The developing roller 110 will be re-used if there is no defect as a result of the inspection. In the case of re-using the developing roller 110, the developing roller 110 may be re-mounted to the very cartridge B (frame 113) that is deprived of if. Or, it may be mounted to another cartridge B (frame 113). In the case of re-using the frame 113 (developer accommodating portion 114), the developer is refilled into the developer accommodating portion 114. In the case of carrying out the refilling of the developer, the cleaning of the frame 113 (developer accommodating portion 114) is carried out before the refilling. In the case where the developing roller 110 is reused, a new frame 113 (developer accommodating portion 114) may be used. In addition, also in the case of re-using the supply roller 115, the case of the developing roller described above applies. If the developing roller 110 and the supply roller 115 are not to be re-used, the dismounting operation is unnecessary.

In the case of manufacturing a new cartridge B, the developing roller 110 and the supply roller 115 are mounted to the frame 113 in the order opposite from the steps described above. In the case of carrying out the refilling of the cartridge B, the cartridge B is once disassembled through the process described above. These parts will be re-used, if the parts (developing roller 110, supply roller 115, frame 113, and so on) are inspected, and there is found no defect for the re-usage as a result of the inspection. In the case of re-using the parts, the part thereof may be mounted to another cartridge B (frame 113) different from the very cartridge B (frame 113) that is deprived of the parts. Or, it may be re-attached to the cartridge B itself from which the part is dismounted.

Figure 21:
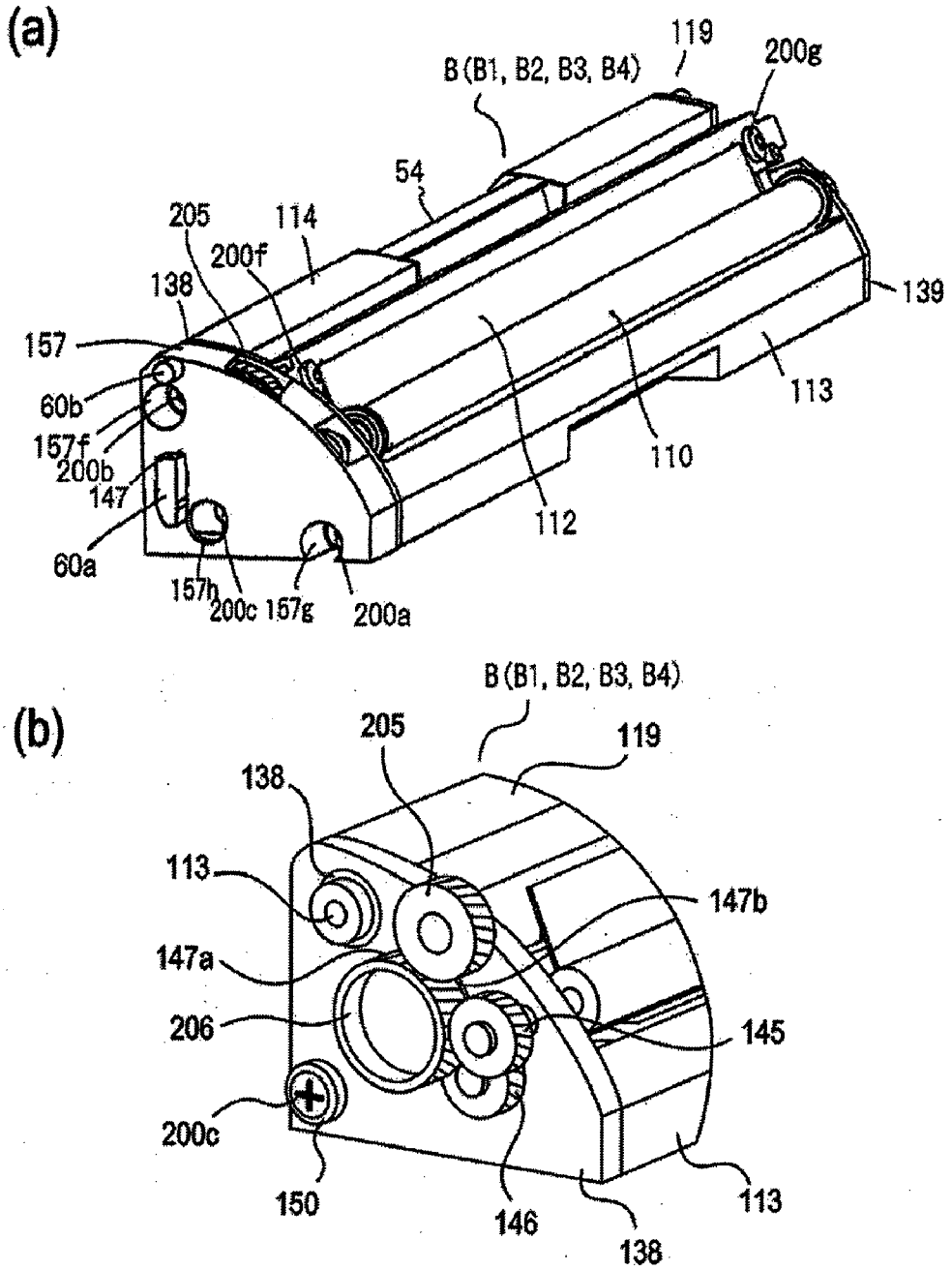
FIG. 21 is perspective view a cartridge (a) and the driving train (b) according to an embodiment of the present invention.

The gear unit U1 may be taken out from the integral portion U2 dismounted from the frame 113, and only the coupling 150 that has been particularly worn to a great extent may be exchanged with a new coupling. As shown in FIG. 22, by moving the coupling 150 in the direction of the arrow Y2 relative to the cylindrical member 147 the retaining portion 147*k* of the cylindrical member 147 deforms. By this, the coupling 150 can be easily dismounted from the cylindrical member 147 (FIG. 21). Therefore, only the worn coupling 150 is exchanged through the simple steps, and the reassembling can be carried out utilizing the other refreshable parts.

In this embodiment, although the developing cartridge has been described, it is not restrictive. The present invention can be applied to the so-called process cartridge that the photosensitive drum and the other process member actable on the photosensitive drum are constituted integrally, for example.

Figure 23:
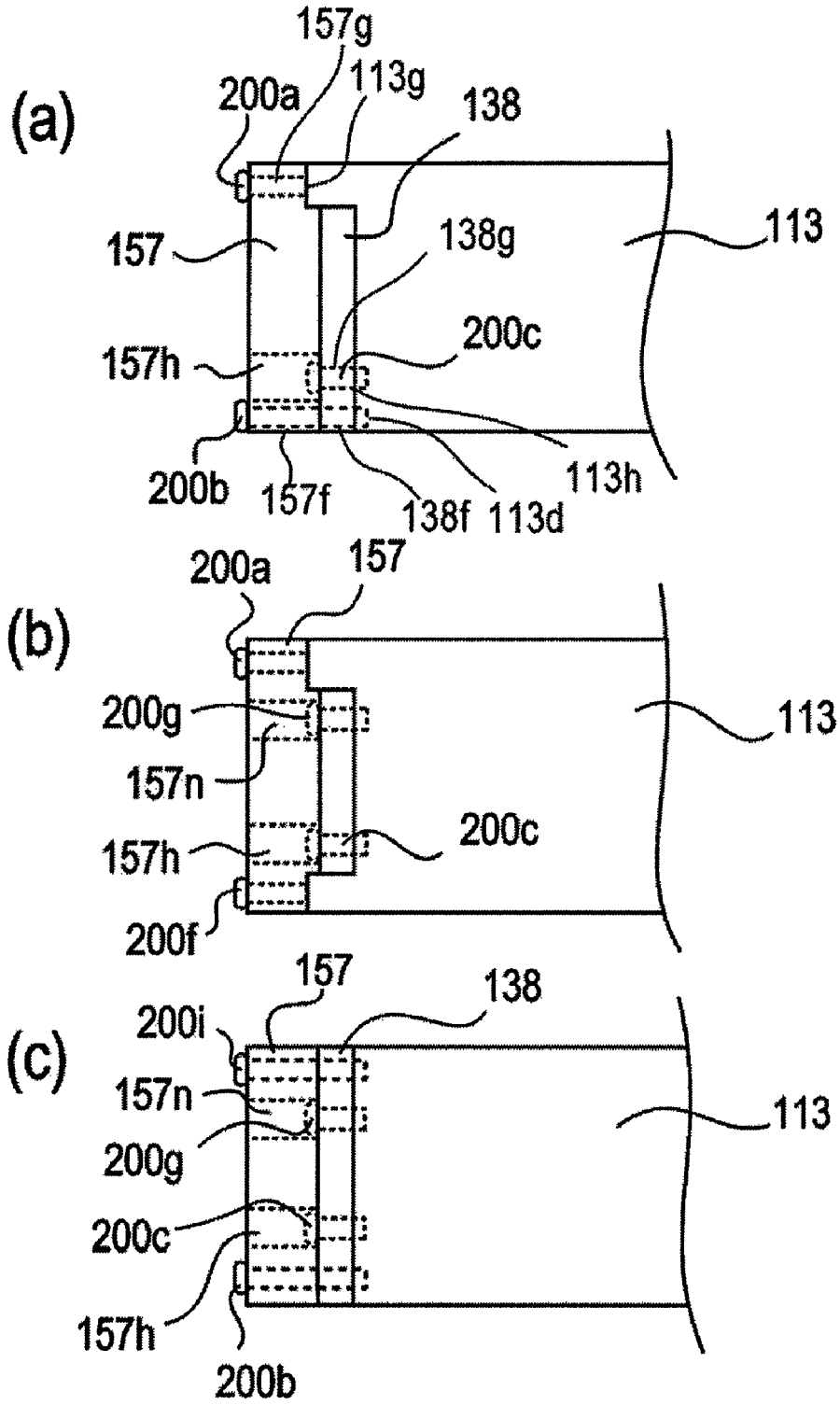
FIG. 23 is an arrangement illustrating the securing of the bearing member, the side cover, the frame according to an embodiment of the present invention.

FIG. 23 is a side view illustrating the state that the side cover 157 and the bearing member 138 secures to the frame 113 by the screw. In FIG. 23, (a) is a side view illustrating the present embodiment. As has been described hereinbefore, the screw 200*a* secures the side cover 157 and the frame 113 with each other. The screw 200*b* fastens together the side cover 157 and the bearing member 138 to the frame 113. The screw 200*c* secures the bearing member 138 to the frame 113. The screw 200*c* can be secured and released from the outside of the side cover 157 by a screw driver (tool), for example which enters through the hole 157*h*. As has been described hereinbefore, the side cover 157 and the bearing member 138 are mounted (secured, fastened) to the frame 113 as will be described below.

The bearing member 138 is mounted to the frame 113 by the screw (first screw, first fastening member) 200*c*. The screw 200*c* can be secured from the outside of the side cover 157 to the frame 113 with respect to the longitudinal direction of the frame 113. In addition, the removing operation can be carried out from the outside. This is because a screw driver for securing (releasing) the screw 200*c* can be inserted through the hole 157*h* provided in the side cover 157. In other words, the screw 200*c* enters through the hole 157*h* provided in the side cover 157, and the through-hole 138*g* provided in the bearing member 138 is penetrated to be secures to the fastening portion 1113*h* provided on the frame 113. In addition, the screw 200*c* can be secured or released by the driver, for example (tool) inserted through the hole 157*h*. The advantageous effects as will be described hereinafter are provided by this structure.

The side cover 157 is directly secured to the frame 113 by the screw (second screw, second fastening member) 200*a*. In addition, the side cover 157 is secured to the frame 113 with the bearing member 138 by the screw (third screw, third fastening member) 200*b*. More particularly, they are threaded together. The effects as will be described hereinafter are provided by these structures. In this embodiment, the side cover 157 is provided with the hole 157*h* so that the bearing member 138 can be secured from the outside of the side cover 157 with respect to the longitudinal direction of the frame 113 to the frame 113. However, the present embodiment is not limited to this structure. A cut-away portion may be used in place of the hole in the side cover 157, for example. However, by the structure of providing the hole in the side cover 157 can maintain the strength of the side cover 157, as compared with providing the cut-away portion. In addition, an area which covers the gears 145, 146 by the side cover 157 can be increased. In addition, an area in which the bearing member 138 is covered by the side cover 157 can be increased.

The assembling method of the cartridge B described above is as follows. The method for mounting the side cover 157 and the bearing member 138 to the frame 113 is as follows. First, the bearing member 138 is directly secured from the outside of the side cover 157 to the frame 113 with respect to the longitudinal direction of the frame 113 by the screw (first screw) 200*c*. The side cover 157 is directly secured to the frame 113 by the screw (second screw) 200*a*. And, the side cover 157 is secured to the frame 113 together with the bearing member 138 by the screw (third screw) 200*b* (FIG. 13 (*b*), FIG. 23 (*a*)). According to this method, the overlaid side cover 157 and the bearing member 138 can be moved along the frame 113, and they can be secured through a series of operations by the screws 200*a, b*, and *c*. Therefore, the assembling operativity can be improved.

The side cover 157 is fastened together to the frame 113 with the bearing member 138 by the screw 200*b*. Also by this, the assembling operativity can be improved. It is preferable to secure the bearing member 138 to the frame 113 first by the screw 200*b* and 200*c*. However, any are sufficient as to the order of the securing by the screw 200*a* and the securing by the screw 200*b*. In addition, in mounting the bearing member 139 to the frame 113, the bearing member 139 is directly secured to the frame 113 by the screw (fourth screw) 200*d*. The bearing member 139 is directly secured to the frame 113 by the screw 200*e* (fifth screw) (FIG. 20 (*b*), (c)).

Referring to FIG. 23, (b) and (c) illustrate another embodiment of the present invention. In FIG. 23, (b) shows an example of using screws 200*g*, 200*f* in addition to the screw 200*a*, 200*c* . . . The screw 200*g* secures the bearing member 138 to the frame 113. The screw 200*g* can be secured to and released from the exterior of the side cover 157 by the driver (tool) which enters the hole 157*n*. The screw 200*f* secures the side cover 157 to the frame 113. In other words, the screw 200*g* has the structure similar to the screw 200*c*, and the screw 200*f* has the structure similar to the screw 200*a*. The side cover 157 and the bearing member 138 are not fastened together in this embodiment.

FIG. 23, (c) illustrates an example in which a screw 200*i* is used in addition to the screws 200*b*, 200*c*, 200*g*. The screw 200*i* fastens together the side cover 157 and the bearing member 138 to the frame 113. More particularly, in this embodiment the screws 200*b*, 200*i* are used and the side cover 157 and the bearing member 138 are fastened together at two positions.

More particularly, in this embodiment the side cover 157 is disposed on the outside with respect to the longitudinal direction of the frame 113, the bearing member 138 is disposed inside, and they are secured together to the frame 113. According to this embodiment, a structure for securing the bearing member 138 to the frame 113 is such that the securing operation is possible from the outside of the side cover 157 with respect to the longitudinal direction of the frame 113. More particularly, the structures of the screw 200*c* and the hole 157*h* and the screw 200*g* and the hole 157*n* according to the embodiment described above are used.

By this, according to this embodiment, in securing them to the frame 113, while disposing the side cover 157 outside and disposing the bearing member 138 inside, the screw fastening can be carried out from the outside of the side cover 157. Additionally, according to this embodiment, the screw-fastening of the side cover 157 and the bearing member 138 can be carried out to the frame 113 by a series of operations, and therefore, the assembling operativity can be improved. In more detail, after the screw-fastening of the bearing member 138 is carried out to (frame 113), it is unnecessary to carry out the screw-fastening of the side cover 157 to the frame 113, while the side cover 157 is opposed to the frame 113.

According to this embodiment, the screw-fastening of the both members 138, 157 can be carried out to the frame 113 together. Therefore, individual mounting operations for both members 138, 157 are unnecessary. In the case of dismounting the both members 138, 157 from the frame 113, the dismounting operation of the screw which secures the both members 138, 157 to the frame 113 can be carried out from the outside of the side cover 157. In addition, the dismounting operation of this screw can be carried out as a series of operations.

Therefore, the operativity in the dismounting of the both members 138, 157 from the frame 113 can be improved. In addition, the mounting operativity can be improved by fastening together the both members 157, 138 to the frame 113. In addition, in the case of the disassembling, the removal operativity can be improved.

In the mounting method of the coupling member, and the assembling method of the cartridge in the embodiments described above, an automatic assembling machine (so-called robot) may be used, or may manually be carried out with tools. In addition, the dismounting method of the coupling member and the disassembling method of the cartridge may be mainly carried out manually with tools. However, the automatic assembly machine may be used properly.

According to the embodiment described above, in mounting the coupling 150 to the cartridge B, the operativity can be improved. In dismounting the coupling 150 from the cartridge B, the operativity can be improved. The mounting method of the coupling 150 wherein the mounting operativity is improved in mounting the coupling 150 to the cartridge B can be provided. In addition, the dismounting method of the coupling 150 wherein the dismounting operativity in dismounting the coupling 150 from the cartridge B is improved, can be provided.

Figure 24:
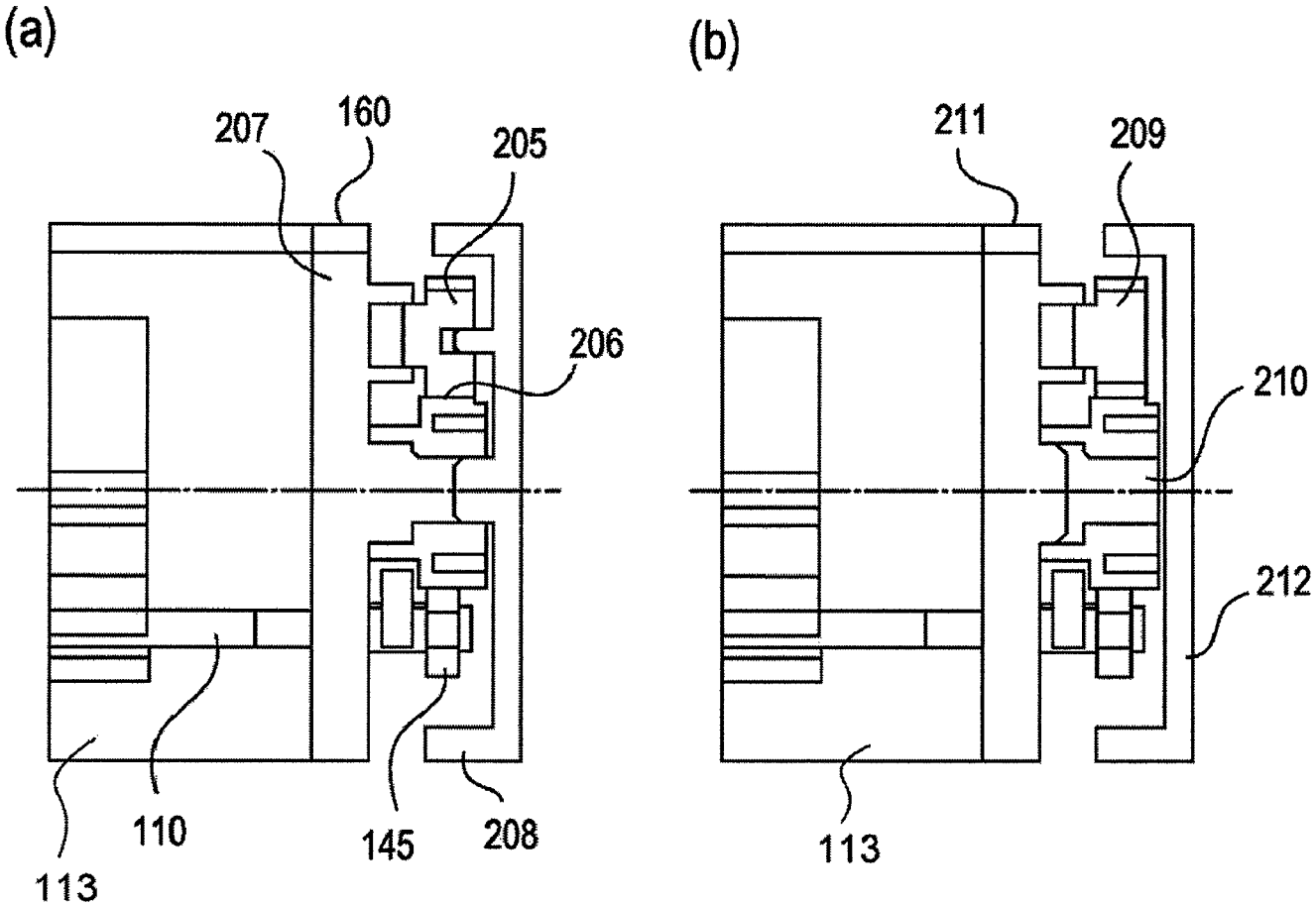
FIG. 24 shows a side sectional view of a drive unit according to (a) and a side sectional view (b) of the drive unit an embodiment of the present invention.

The description will be made about the embodiment in which a gear is used instead of the coupling 150 as the rotational force receiving member. As shown in FIG. 2 (*a*) and so on, in the embodiments described above, the coupling 150 has been taken as the rotational force receiving member for receiving the rotational force from the main assembly A. However, the present embodiment is not limited to this example. As shown in FIG. 24, the a member for receiving the rotational force from the main assembly A may be the driving force input gear (the rotational force receiving member) 205.

In more detail, the gear 205 receives the rotational force from the main assembly A, and the rotational force is transmitted to the developing roller 110 through the gear 206 in engagement with the gear 205 and the development gear 145.

As shown in FIG. 24 (*a*), in this embodiment, said one axial end of the gear 205 and the gear 206 is supported rotatably by a bearing member 207, and the other end portion thereof is supported rotatably by a side cover 208. However, this structure is not restrictive. As shown in FIG. 7 (*f*), in addition, one axial end of the cylindrical member 147 is supported rotatably by a bearing member 138, and the other end portion thereof is supported rotatably by a side cover 157. However, this structure is not restrictive.

An example is shown in FIG. 24 (*b*). In this embodiment only said one axial end of the gear 209 and the gear 210 is supported by the bearing member 211, and the other end portion thereof is supported by the side cover 212 to prevent the dislodgement. Such a structure is also applicable.

According to the embodiment described above, in the cartridge B, in mounting the side cover 157 and the bearing member 138 to the frame 113, the mounting operativity can be improved. In addition, in the cartridge B, in dismounting the side cover 157 and the bearing member 138 from the frame 113, the dismounting operativity can be improved. In addition, in the cartridge B, the assembling method of the cartridge wherein the mounting operativity is improved in mounting the side cover 157 and the bearing member 138 to the frame 113 can be provided. In addition, in the cartridge B, the disassembling method of the cartridge that the dismounting operativity is improved in dismounting the side cover 157 and the bearing member 138 from the frame 113 can be provided.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 161117/2008 filed Jun. 20, 2008 which is hereby incorporated by reference.

What is claimed is:

1. A cartridge detachably mountable to a main assembly of an electrophotographic image forming apparatus, said cartridge comprising:

a developer accommodating portion for accommodating a developer;

a developing roller for developing an electrostatic latent image formed on an electrophotographic photosensitive drum with the developer accommodated in said developer accommodating portion;

a cartridge frame extended in a longitudinal direction of said developing roller;

a rotational force receiving member for receiving, from the main assembly, a rotational force for rotating said developing roller in a state in which said cartridge is mounted to the main assembly;

a side cover provided outside said cartridge frame with respect to the longitudinal direction of developing roller; and a fastening member fastening said side cover to said cartridge frame to mount said side cover to said cartridge frame, wherein said side cover is provided with an elastic member and an inclination regulating portion for regulating an inclination of said rotational force receiving member, with said rotational force receiving member being inclinable by an elastic force of said elastic member, and wherein, when said side cover is mounted to said cartridge frame by said fastening member, said rotational force receiving member is mounted to said cartridge frame integrally with said side cover.

2. A cartridge according to claim 1, wherein said rotational force receiving member is a coupling member, and includes a cylindrical member movably supporting one end portion of said coupling member at an inside of said cylindrical member, said cylindrical member including a cylindrical member side force receiving portion, provided inside said cylindrical member, for receiving a rotational force received from the main assembly by said coupling member, and a first gear, provided on an outer periphery of said cylindrical member, for transmitting the rotational force received by said cylindrical member side force receiving portion to said developing roller, wherein said rotational force receiving member further includes a second gear, provided on said developing roller shaft portion, for transmitting the rotational force received from the main assembly by said coupling member to said developing roller, and wherein, in the state in which said cartridge is mounted to the main assembly, the rotational force from a main assembly driving shaft provided in the main assembly is transmitted through said coupling member, said cylindrical member, said first gear and said second gear to said developing roller to rotate said developing roller.

3. An assembly method for assembling a cartridge detachably mountable to a main assembly of an electrophotographic image forming apparatus, said cartridge including:

a developer accommodating portion for accommodating a developer;

a developing roller for developing an electrostatic latent image formed on an electrophotographic photosensitive drum with the developer accommodated in said developer accommodating portion;

a rotational force receiving member for receiving a rotational force for rotating said developing roller from the main assembly in a state in which said cartridge is mounted to the main assembly;

a cartridge frame extended in a longitudinal direction of said developing roller; and a side cover provided outside said cartridge frame with respect to the longitudinal direction of said developing roller, said method comprising:

a step of fastening said side cover to said cartridge frame by a fastening member to mount said side cover to said cartridge frame, wherein said side cover is provided with an elastic member and an inclination regulating portion for regulating an inclination of said rotational force receiving member, with said rotational force receiving member being inclinable by an elastic force of said elastic member, and wherein, when said side cover is mounted to said cartridge frame by said fastening member, said rotational force receiving member is mounted to said cartridge frame integrally with said side cover.

4. A disassembly method for disassembling a cartridge detachably mountable to a main assembly of an electrophotographic image forming apparatus, said cartridge including:

a developer accommodating portion for accommodating a developer;

a developing roller for developing an electrostatic latent image formed on an electrophotographic photosensitive drum with the developer accommodated in said developer accommodating portion;

a rotational force receiving member for receiving a rotational force for rotating said developing roller from the main assembly in a state in which said cartridge is mounted to the main assembly;

a cartridge frame extended in a longitudinal direction of said developing roller; and a side cover provided outside said cartridge frame with respect to the longitudinal direction of said developing roller, said method comprising:

a step of removing a fastening member to dismount said side cover from said cartridge frame, wherein said side cover is provided with an elastic member and an inclination regulating portion for regulating an inclination of said rotational force receiving member, with said rotational force receiving member being inclinable by an elastic force of said elastic member, and wherein, when said side cover is dismounted from said cartridge frame by removing said fastening member, said rotational force receiving member is dismounted from said cartridge frame integrally with said side cover.

* * * * *